United States Patent [19]

Blazek

[11] Patent Number: 4,961,459

[45] Date of Patent: Oct. 9, 1990

[54] METHOD OF MAKING AN IMPROVED TURBINE ENGINE COMPONENT

[75] Inventor: William S. Blazek, Valley City, Ohio

[73] Assignee: PCC Airfoils, Inc., Cleveland, Ohio

[21] Appl. No.: 364,702

[22] Filed: Jun. 9, 1989

Related U.S. Application Data

[63] Continuation-in-part of Ser. No. 301,867, Jan. 25, 1989.

[51] Int. Cl.[5] ..... B22D 19/04

[52] U.S. Cl. ..... 164/122.1; 164/108; 164/112; 164/10; 164/35

[58] Field of Search ..... 164/9, 10, 11, 34, 35, 164/36, 98, 111, 112, 122, 122.1, 137, 108; 29/156.8 R

[56] References Cited

U.S. PATENT DOCUMENTS

| | | | |
|---|---|---|---|
| 2,402,418 | 6/1946 | Kroon . | |
| 2,681,788 | 6/1954 | Wosika . | |
| 4,195,683 | 4/1980 | Blazek | 164/35 |
| 4,728,258 | 3/1988 | Blazek et al. | 164/35 |

*Primary Examiner*—Richard K. Seidel

*Attorney, Agent, or Firm*—Tarolli, Sundheim & Covell

[57] ABSTRACT

An improved turbine engine component includes an annular array of airfoils which extend between inner and outer shroud rings. In order to accommodate thermal expansion of the airfoils, cavities are provided in one of the shroud rings. The cavities may be formed by moving a shroud ring under the influence of forces applied to the shroud ring by a gating system. The cavities which are formed in the shroud ring to accommodate thermal expansion of the airfoils may be open-ended, completely closed-ended or partially closed-ended. When a turbine engine component having cavities in an inner shroud ring is to be formed, molten metal in an outer shroud ring mold cavity is first solidified to firmly grip outer ends of the airfoils. The molten metal in an inner shroud ring mold cavity is then solidified. As the molten metal in the inner shroud ring mold cavity solidifies, the gating system contracts to pull the metal in the inner shroud ring mold cavity inwardly relative to the airfoils. Core material may be positioned at the ends of the airfoils to at least partially form the shroud ring cavities.

44 Claims, 7 Drawing Sheets

METHOD OF MAKING AN IMPROVED TURBINE ENGINE COMPONENT

BACKGROUND OF THE INVENTION

This application is a continuation-in-part of allowed U.S. Pat. Application Ser. No. 301,867, filed Jan. 25, 1989 by William S. Blazek and entitled "Method of Making a Turbine Engine Component".

The present invention relates to a new and improved turbine engine component and the method by which it is made. Specifically, the present invention relates to a turbine engine component having a plurality of airfoils disposed in an annular array between inner and outer shroud rings.

A method of making a turbine engine component having an annular array of airfoils disposed between inner and outer shroud rings is disclosed in U.S. Pat. No. 4,728,258, issued Mar. 1, 1988 and entitled "Turbine Engine Component and Method of Making the Same". Slip joints are provided between the airfoils and an outer shroud ring to accommodate thermal expansion of the airfoils relative to the inner shroud ring. When the airfoils are heated to a temperature above the temperature of the shroud ring, thermal expansion of the airfoils causes the slip joints to open.

The turbine engine component disclosed in the aforementioned U.S. Pat. No. 4,728,258 is satisfactory. However, the turbine engine component disclosed in this patent does not have shroud rings with cavities to accommodate thermal expansion of the airfoils relative to the shroud rings. Therefore, when the airfoils expand relative to the shroud rings, they project from one of the shroud rings.

In addition, when the airfoils of the turbine engine component described in the aforementioned U.S. patent expand relative to the shroud rings, there is a slight possibility that some gas may leak in a radial direction along the airfoils through the shroud ring. Of course, any leakage of gas in a radial direction along the airfoils through the shroud rings would be detrimental to the operation of an engine. Therefore, it may be desirable to avoid even the remote possibility of a very slight leakage of gas in a radial direction along the airfoils.

BRIEF SUMMARY OF THE INVENTION

The present invention provides a new and improved method of making an improved turbine engine component having a plurality of airfoils disposed between shroud rings. Cavities are provided in at least one of the shroud rings adjacent to end portions of the airfoils to accommodate thermal expansion of the airfoils. The cavities may be open-ended, completely closed-ended, or partially closed-ended.

When one specific embodiment of the improved turbine engine component is to be made, a plurality of airfoils are positioned in an annular array with end portions of the airfoils at least partially enclosed by a shroud ring pattern. The shroud ring pattern is covered with mold material. The shroud ring pattern material is then removed to leave a shroud ring mold cavity. Molten metal is poured into the shroud ring mold cavity and solidified. Cavities are formed in the shroud ring at locations adjacent to end portions of the airfoils by causing relative movement to occur between the airfoils and the shroud ring.

The relative movement between the airfoils and the shroud ring may be induced by thermal contraction of metal in a gating system through which molten metal was supplied to the shroud ring mold cavity. Thus, as the metal in the gating system solidifies and contracts, the shroud ring is pulled away from the ends of the airfoils by the metal in the gating system to form cavities or spaces in the shroud ring. If desired, the cavities in the shroud ring could be formed by moving the airfoils rather than the metal of the shroud ring. In another specific embodiment of the invention, core material is used in the formation of the cavities. The core material is located at the ends of airfoils which are enclosed by a shroud ring pattern. The shroud ring pattern and the core material are covered with ceramic mold material. The shroud ring pattern material is removed and molten metal is poured into the resultant mold cavity. After the molten metal has solidified to form a shroud ring, the core material is removed from the shroud ring.

The cavities or spaces which are formed in a shroud ring may have completely closed ends to prevent even a very small flow of gas in a radial direction along the airfoils through the shroud ring. If desired, the cavities could be formed with partially open ends. End wall sections of these cavities form bridge or connector sections which extend across ends of the airfoil to transmit forces and prevent deformation of the shroud ring. Of course, completely open-ended cavities could be provided in the shroud ring.

BRIEF DESCRIPTION OF THE DRAWINGS

The foregoing and other features of the present invention will become more apparent upon a consideration of the following description taken in connection with the accompanying drawings, wherein.

DESCRIPTION OF SPECIFIC PREFERRED EMBODIMENTS OF THE INVENTION

Turbine Engine Component

Figure 1:
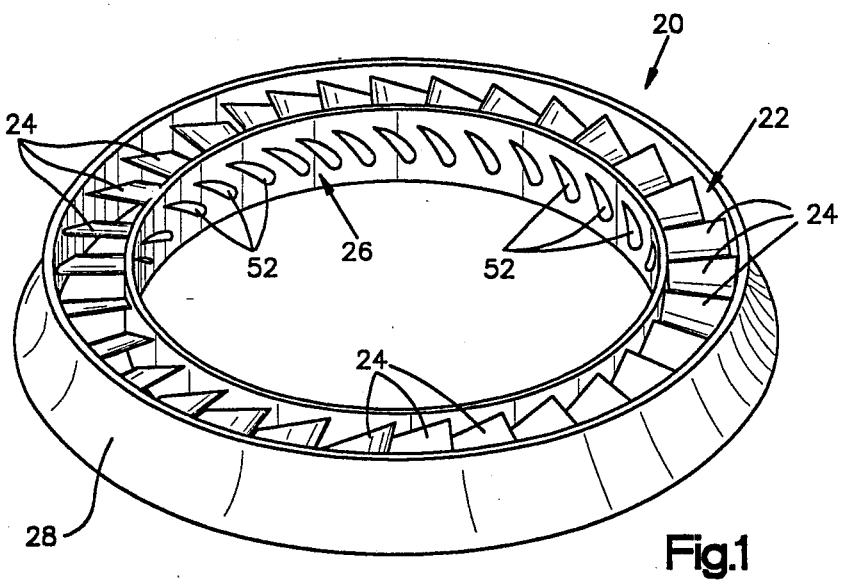
FIG. 1 is a pictorial illustration of a turbine engine component having a shroud ring with open-ended cavities to accommodate thermal expansion of airfoils.

A turbine engine component 20 constructed in accordance with the present invention is illustrated in FIG. 1. The turbine engine component 20 has a stator which will be fixedly mounted between the combustion chamber and first stage rotor of a turbine engine. The hot gases from the combustion chamber are directed against an annular array 22 of airfoils or vanes 24 which extend between a one-piece annular cast hub or inner shroud ring 26 and a one-piece annular cast rim or outer shroud ring 28. Although it is believed that a turbine engine component constructed in accordance with the present invention will be particularly advantageous when used between the combustion chamber and first stage rotor of a turbine engine, it should be understood that turbine engine components constructed in accordance with the present invention can be used at other locations in an engine.

The airfoils 24 are formed separately from the annular inner and outer shroud rings 26 and 28. This allows the airfoils 24 to be formed of metal and/or ceramic materials which can withstand the extremely high operating temperatures to which they are exposed in the turbine engine. Since the shroud rings 26 and 28 are subjected to operating conditions which differ somewhat from the operating conditions to which the airfoils 24 are subjected, the shroud rings 26 and 28 can advantageously be made of materials which are different from the materials of the airfoils 24.

In the present instance, the airfoils 24 are cast as a single crystal of a nickel-chrome superalloy metal. The airfoils 24 may be cast by a method generally similar to that disclosed in U.S. Pat. No. 3,494,709. However, it should be understood that the airfoils 24 could be formed with a different crystallographic structure and/or of a different material if desired. For example, it is contemplated that the airfoils 24 could have a columnar grained crystallographic metal structure or could be formed of a ceramic or metal and ceramic material if desired.

Although the shroud rings 26 and 28 of FIG. 1 do not have rails, it is contemplated that either or both of the shroud rings may be provided with one or more rails. Annular shroud ring rails are commonly used to facilitate mounting of the turbine engine component 20 in an engine and to strengthen the shroud rings. The rails may be axially spaced from the ends of the airfoils 24 or may extend across the ends of the airfoils.

During operation of a turbine engine, the airfoils 24 will be heated to a higher temperature than the inner and outer shroud rings 26 and 28. Due to the fact that the airfoils 24 are heated to a higher temperature than the shroud rings 26 and 28, there will be greater thermal expansion of the airfoils than the shroud rings. Slip joints 32 (FIGS. 2 and 3) are provided between the inner shroud ring 26 and a root or inner end portion 34 of each of the airfoils 24 to accommodate thermal expansion of the airfoils. Although the slip joints 32 have been shown as being between the annular inner shroud ring 26 and the airfoils 24, the slip joints could be provided between the annular outer shroud ring 28 and the airfoils if desired, using the other shroud ring as the attachment shroud ring.

An outer end portion 38 of each of the airfoils 24 is anchored in and held against movement relative to the rim or outer shroud ring 28. Therefore, upon heating of the airfoils 24 to a temperature which is above the temperature of the shroud rings 26 and 28, each airfoil expands radially inwardly to a slip joint 32 (FIG. 3) between the root or inner end portion 34 of the airfoil and the hub or inner shroud ring 26. By providing for relative movement between the airfoils 24 and the shroud rings 26 and 28 at the slip joints 32, the application of thermal stresses to the airfoils 24 is avoided. Since there are no metallurgical bonds between the airfoils 24 and the inner shroud ring 26, the end portions 34 of the airfoils 24 are readily moved relative to the inner shroud ring 26 with the application of a minimum of stress to the airfoils.

Figure 2:
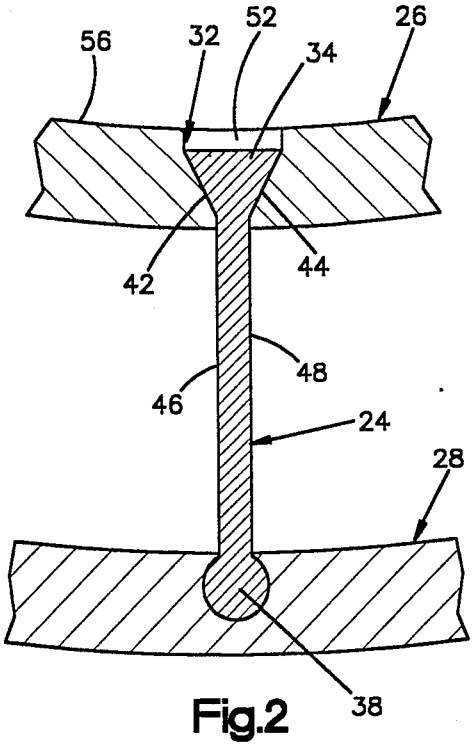
FIG. 2 is a schematic sectional view illustrating the relationship between an airfoil and an open-ended cavity in the shroud ring of the turbine engine component of FIG. 1 when the airfoil and shroud ring are at the same temperature.
Figure 3:
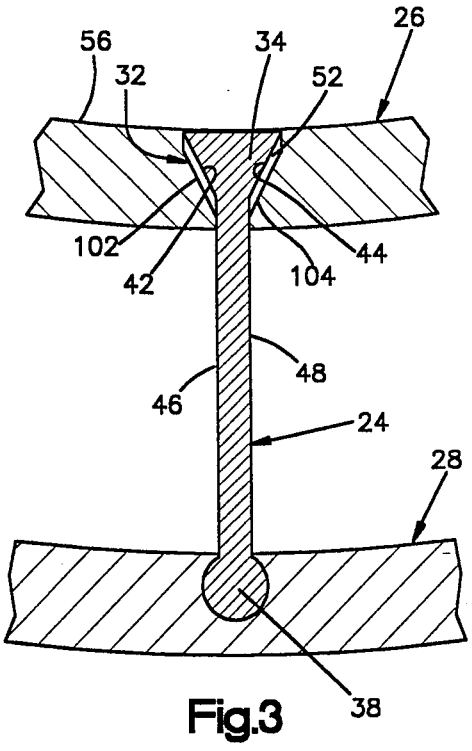
FIG. 3 is a sectional view, generally similar to FIG. 2, illustrating the manner in which thermal expansion of the airfoil opens a slip joint as the airfoil expands into the open-ended cavity in the shroud ring.

Each of the identical airfoils 24 (FIG. 1) has a relatively wide bulbous outer end portion 38 (FIGS. 2 and 3). Thus, the outer end portion 38 provides for a mechanical interconnection between the airfoil 24 and the outer shroud ring 28 along the width of the airfoil. Due to the mechanical connection between the outer end 38 of the airfoil 24 and the outer shroud ring 28, the outer end portion of each airfoil 24 is anchored and cannot move radially inwardly relative to the outer shroud ring 28. Although one specific type of mechanical connection between the end 38 of the airfoil 24 and the outer shroud ring has been shown, other types of connections could be used if desired.

The inner end portion 34 of the airfoil is tapered outwardly from the inner shroud ring 26 toward the outer shroud ring 28 (FIG. 2). Thus, the outer end portion 34 of the airfoil 24 has a pair of sloping side surface areas 42 and 44 (FIGS. 2 and 3) which slope outwardly to a concave major side surface 46 of the airfoil 24 and a convex major side surface 48 of the airfoil. In the illustrated embodiment of the airfoils 24, the side surfaces 42 and 44 are each disposed at an angle of approximately 25° to a radial plane. However, the side surfaces could slope at a different angle to the radial plane, for example, at an angle of 2° or 3° .

In accordance with a feature of the present invention, cavities 52 (FIG. 2) are formed in the inner shroud ring 26 to accommodate expansion of the airfoils 24 from the retracted condition of FIG. 2 to the extended condition of FIG. 3. Each cavity 52 has a radial extent which is sufficient to accommodate the thermal expansion of the airfoil 24. Therefore, the end portion 34 of the airfoil 24 does not project past a circular inner side surface 56 of the inner shroud ring 26 when the airfoil is in the extended or thermally expanded condition of FIG. 3.

If the inner shroud ring 26 is provided with one or more annular rails, the rail may extend across the ends of the airfoils 24. If the rail extends across the ends of the airfoils, the rail will partially block the open ends of the cavities 52. However, the cavities 52 will extend radially inwardly from the rail for a sufficient distance to accommodate thermal expansion of the airfoils 24.

MAKING THE TURBINE ENGINE COMPONENT

Figure 4:
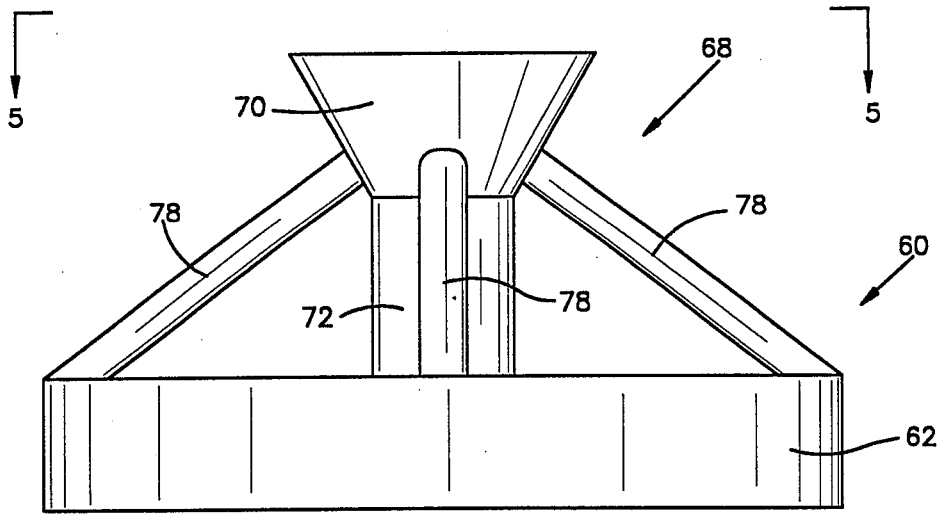
FIG. 4 is a schematic elevational view of a mold used to cast the turbine engine component of FIG. 1.
Figure 5:
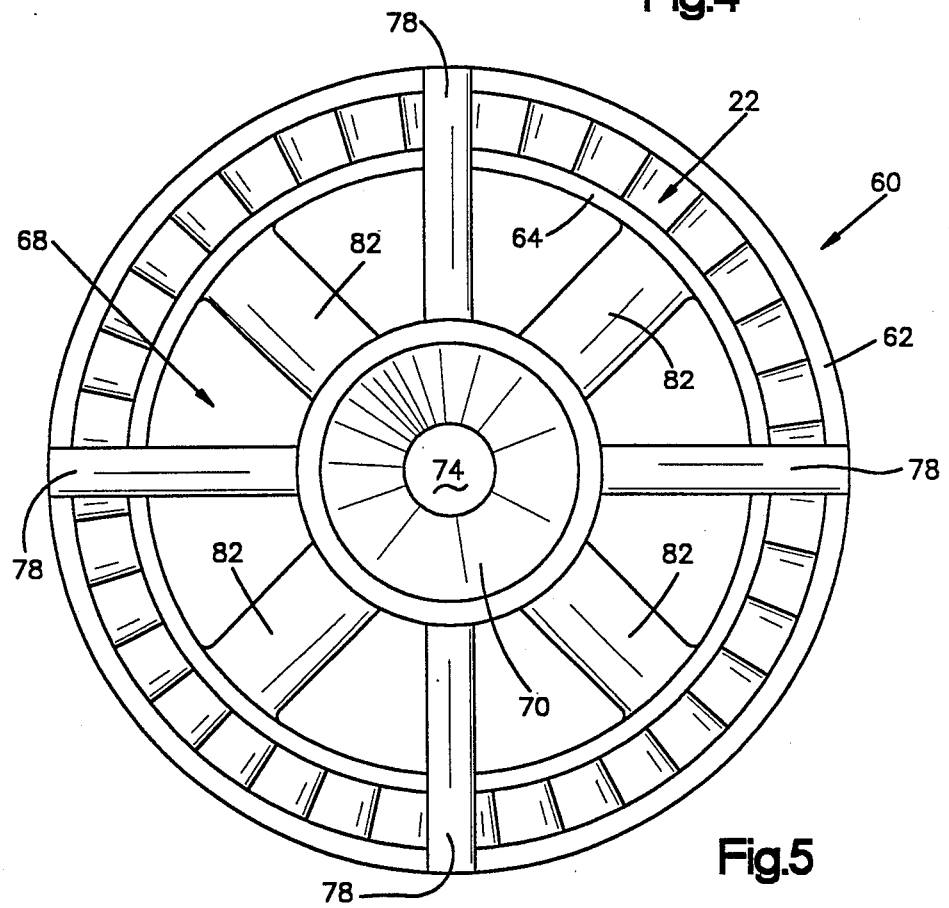
FIG. 5 is a plan view, taken generally along the line 5—5 of FIG. 4, illustrating the relationship of a gating system to inner and outer shroud ring-forming portions of the mold.

A mold 60 for forming the one-piece annular and outer shroud rings 26 and 28 with the airfoils 24 extending between the shroud rings is schematically illustrated in FIGS. 4 and 5. The one-piece mold 60 includes an annular outer shroud ring-forming portion 62 and an annular inner shroud ring-forming portion 64 (FIG. 5). The airfoils 24 are disposed in an annular array 22 and extend between the shroud ring-forming portions 62 and 64. A gating system 68 conducts molten metal to the annular shroud ring-forming portions 62 and 64.

The gating system 68 includes a pour cup 70 which is connected with a downpole 72 having a relatively large vertically extending passage 74 (FIG. 5). A plurality of runners 78 extend radially outwardly from the downpole 72 and are connected with the outer shroud ring-forming portion 62. A plurality of relatively large runners 82 (FIG. 5) extend radially outwardly from the lower end portion of the downpole 72 and are connected with the inner shroud ring-forming portion 64. The runners 82 have relatively large passages which hold a substantially greater volume than do the runners 78 for the outer shroud ring-forming portion 62. If the inner shroud ring 26 is provided with an annular rail, the runners 82 would be connected with rail forming portions of the shroud ring mold cavity. This facilitates the feeding of molten metal to the shroud ring mold cavity and adds to the mass of metal connected with the runners 82.

It should be understood that the mold 60 has been illustrated schematically in FIGS. 4 and 5. In one preferred embodiment of the invention, the mold was constructed in a manner similar to that disclosed in the aforementioned U.S. Pat. No. 4,728,258, issued Mar. 1, 1988 and entitled "Turbine Engine Component and Method of Making the Same". However, the runners 82 for the inner shroud ring forming portion 64 are interconnected with each other and the downpole 70 in the manner shown in FIG. 5.

When the one-piece annular shroud rings 26 and 28 (FIG. 1) are cast in the annular shroud ring-forming portions 62 and 64 of the mold 60 (FIG. 5), molten metal is poured into the pour cup 70. This molten metal is conducted outwardly to the outer shroud ring-forming portion 62 through the runners 78. The molten metal is also conducted outwardly from the downpole passage 74 to the inner shroud ring-forming portion 64 through the runners 82.

The molten metal in the outer shroud ring-forming portion 62 solidifies before the molten metal in the inner shroud ring-forming portion 64. This is because the outer shroud ring-forming portion 62 is exposed to a relatively cool environment, while the inner shroud ring-forming portion is enclosed by the outer shroud ring-forming portion 62 and is close to the relatively large mass of hot metal in the gating system 68. As the molten metal in the outer shroud ring-forming portion 62 solidifies to form the outer shroud ring 28, the metal firmly grips the bulbous outer end portions 38 of the airfoils 24 (FIGS. 2 and 3) to hold the airfoils 24 against movement relative to the outer shroud ring 28.

After the molten metal in the annular outer shroud ring-forming portion 62 has solidified, the molten metal in the inner shroud ring-forming portion 64 solidifies. As solidification of the molten metal in the annular inner shroud ring-forming portion 64 is being completed, the solidification of the molten metal in the gating system 68 is occurring. As the molten metal in the gating system cools and solidifies, the metal in the gating system 68 contracts.

Contraction of the metal in the gating system 68 causes the metal to apply radially inwardly directed forces of a relatively large magnitude to the metal in the inner shroud ring-forming portion 64. Although the radially inwardly directed forces are applied to the inner shroud ring 26 at each of the locations where the inner shroud ring forming portion 64 of the mold 60 (FIG. 5) is connected with a runner 82, the inwardly directed forces are represented schematically by the single arrow 84 in FIG. 9. At this time, the airfoils 24 are firmly held by the solidified metal in the outer shroud ring-forming portion 62. Therefore, the forces applied by the gating system 68 pulls the annular body of metal in the inner shroud ring-forming portion 64 radially inwardly relative to the annular array of airfoils 24 and the metal in the outer shroud ring-forming portion 62. If the inner shroud ring 26 is provided with one or more annular rails, the rails will contribute to the mass of contracting metal which pulls the shroud ring inwardly.

Figure 9:
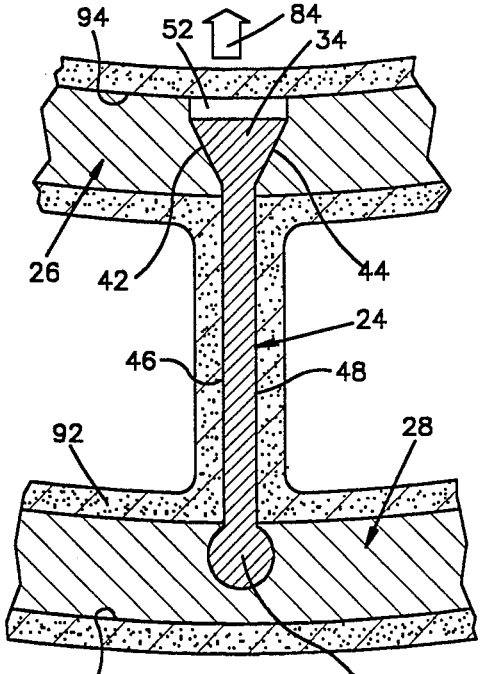
FIG. 9 is a fragmentary sectional view schematically illustrating the manner in which an annular shroud ring is moved relative to the airfoil of FIG. 8 to form an open-ended cavity in the shroud ring during contraction of metal in the gating system of the mold of FIGS. 4 and 5.

As the metal in the inner shroud ring-forming portion 64 is pulled inwardly by thermal contraction forces applied to the metal by the metal in the gating system 68, the metal in the inner shroud ring-forming portion 62 moves radially inwardly. As this movement occurs, the inner end portions 34 (FIGS. 2 and 3) of the stationary airfoils 24 plastically deform the hot, almost completely solidified, metal of the inner shroud ring 26 to form the cavities 52 at the ends of the airfoils 24 (FIG. 9). In the embodiment of the invention illustrated in FIGS. 2 and 3, the cavities 52 are open-ended. However, if the inner shroud ring is provided with one or more annular rails, the rails will partially block the ends of the cavities 52.

The cavities 52 (FIG. 2) at the ends of the airfoils 24 have a radial extent of approximately 0.025 of an inch. It should be understood that the radial extent of the cavities 52 has been exaggerated in FIGS. 2 and 3 for purposes of clarity of illustration. However, the radial extent of the cavities 52 is sufficient to accommodate the thermal expansion of the airfoils 24 in a radial direction relative to the inner shroud ring 26 (see FIG. 3). Therefore, when the airfoils 24 are thermally expanded relative to the inner shroud ring 26 during use of the turbine engine component 20 (FIG. 1), the inner end portions 34 of the airfoils 24 do not project inwardly of the circular inner side surface 56 (FIG. 3) of the shroud ring 26. If the inner shroud ring has a rail, the radial extent of the cavities 52 accommodates expansion of the airfoils 24 without interference between the ends of the airfoils and the rail.

Figure 6:
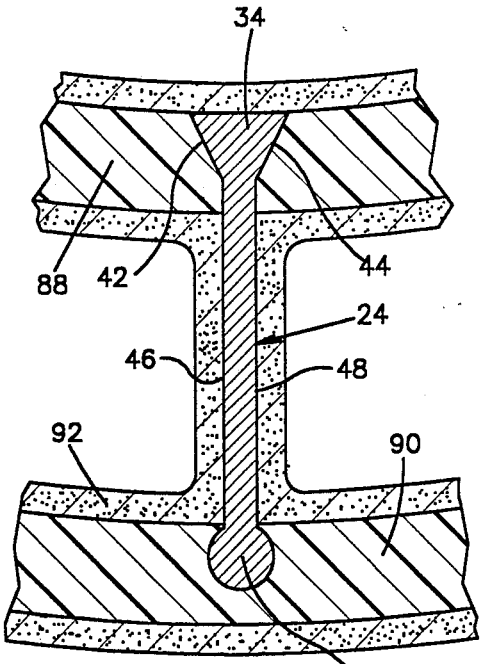
FIG. 6 is a fragmentary sectional view illustrating the manner in which ceramic mold material covers an airfoil and annular shroud ring patterns during the making of the mold of FIGS. 4 and 5.

To fabricate the mold 60, the inner end portion 34 of each of the airfoils 24 is embedded in an annular wax inner shroud ring pattern 88 (FIG. 6). Similarly, the outer end portions 38 of the airfoils 24 are embedded in an annular wax outer shroud ring pattern 90. The annular wax inner and outer shroud ring patterns 88 and 90 can be formed of either a natural or artificial wax in the manner disclosed in U.S. Pat. No. 4,728,258. It should be understood that although only a single airfoil 24 has been shown in FIG. 6 as extending between the annular shroud ring patterns 88 and 90, there is an annular array of preformed airfoils 24 extending between the annular shroud ring patterns in the same manner as in which the annular array 22 of airfoils 24 extends between the inner and outer shroud rings 26 and 28 in FIG. 1.

Each of the metal airfoils 24 is covered with a thin layer of wax. This may be done by obtaining commercially available sheets of wax and wrapping the airfoils in the wax sheet material. The wax sheet material has a uniform thickness.

Once the pattern assembly has been completed, it is covered with a suitable mold material. The mold material solidifies over the outside of the wax shroud ring patterns 88 and 90 and over the thin layer of wax on the surfaces of the airfoils 24. Upon removal of the wax pattern material 88 and 90, the mold material forms annular shroud ring mold cavities having configurations corresponding to the configurations of the wax patterns 88 and 90 and the inner and outer shroud rings 26 and 28. Removal of the thin layer of wax overlying the surfaces of the airfoils 24 leaves space to accommodate thermal expansion of the metal airfoils relative to the ceramic mold material during heating of the mold. If the airfoils 24 are relatively small, the mold material can accommodate the thermal expansion of the airfoils and the thin layer of wax over the airfoils may be omitted.

In order to form a mold 60, the entire pattern assembly is completely covered with liquid ceramic mold material. The ceramic mold material 92 (FIG. 6) completely covers the wax coated surfaces of the metal airfoils, wax inner shroud ring 88, wax outer shroud ring 90, and a wax gating pattern which is connected with the inner and outer shroud rings 88 and 90. The entire pattern assembly may be covered with the liquid ceramic mold material 92 by repetitively dipping the pattern assembly in a slurry of liquid ceramic mold material.

Although many different types of slurries of ceramic mold material could be utilized, one illustrative slurry contains fused silica, zircon, and other refractory materials in combination with binders. Chemical binders such as ethylsilicate, sodium silicate and colloidal silica can be utilized. In addition, the slurry may contain suitable film formers, such as alginates, to control viscosity and wetting agents to control flow characteristics and pattern wettability.

In accordance with common practices, the initial slurry coating applied to the pattern assembly may contain a finely divided refractory material to produce an accurate surface finish. A typical slurry for a first coat may contain approximately 29% colloidal silica suspension in the form of a 20% to 30% concentrate. Fused silica of a particle size of 325 mesh or smaller in an amount of 71% can be employed together with less than 1%–10% by weight of a wetting agent. Generally, the specific gravity of the ceramic mold material may be on the order of 1.75 to 1.80 and have a viscosity of 40 to 60 seconds when measured with a Number 5 Zahn cup at 75° F. to 85° F. After the application of the initial coating, the surface is stuccoed with refractory materials having a particle size on the order of 60 to 200 mesh. Although one known specific type of ceramic mold material has been described, other known types of mold materials could be used if desired.

The ceramic mold material 92 (FIG. 6) extends over the major side surfaces 46 and 48 of the metal airfoils 24. However, there is a small amount of space, left by removal of the thin wax coating, between the surfaces of the airfoils and the ceramic mold material to accommodate thermal expansion of the airfoils. In addition, the mold material overlies an exposed inner end surface on the inner end portion 34 of the airfoil 24. The ceramic mold material 92 also overlies the wax gating pattern which is connected with the annular shroud ring patterns 88 and 90.

After the ceramic mold material 92 has dried or at least partially dried, the mold 60 is heated in a steam autoclave to melt the wax material of the inner and outer shroud ring patterns 88 and 90 and the wax gating pattern material. The melted wax is poured out of the mold 60 through an open end of the pour cup 70 and degreaser is then used to remove any remaining wax.

Removal of the wax pattern material leaves a continuous annular inner shroud ring mold cavity 94 (FIG. 7) and a continuous annular outer shroud ring mold cavity 96. The annular inner shroud ring mold cavity 94 extends around the inner end portions 34 of the airfoils 24. Similarly, the annular outer shroud ring mold cavity 96 extends around the outer end portions 38 of the airfoils 24. Although the inner and outer end portions 34 and 38 of the airfoils 24 are completely enclosed within the inner and outer shroud ring mold cavities 94 and 96, the inner end portions 34 of the airfoils 24 are spaced only a small distance from the ceramic mold material 92 at inner end surfaces of the airfoils 24.

The airfoils 24 expand relative to the ceramic mold material as the mold is heated. Thermal expansion of the airfoils results in the space left by the thin layer of wax over the airfoils being eliminated. Therefore, the inner end portions 34 of the airfoils 24 engage the ceramic mold material 92 at inner end surfaces of the airfoils. In addition, the main body or central portions of the airfoils expand to engage the ceramic mold material. As the airfoils 24 expand, the outer end portions 34 move into engagement with the ceramic mold material 92.

Once the mold 60 has been formed in the manner previously described, the mold is heated to about 1800°

F. Molten metal is then poured into the preheated mold through the pour cup 70. The molten metal flows from the pour cup to the continuous annular inner and outer shroud ring mold cavities 94 and 96 (FIG. 7) through passages in the runners 78 and 82 of the gating system 68. Thus, molten metal flows into the continuous annular outer shroud ring mold cavity 96 through the runners 78. Molten metal flows into the continuous annular inner shroud ring mold cavity 94 through the runners 82.

While the molten metal is flowing into the shroud ring mold cavities 94 and 96 (FIG. 8), the airfoils 24 are held against movement relative to each other and to the mold cavities by the ceramic mold material 92 engaging the major side surfaces 46 and 48 of the airfoils. Since the inner end portions 34 of the airfoils engage the mold material 92, the molten metal does not engage the innermost end surfaces of the airfoils 24. However, the molten metal in the inner and outer shroud ring mold cavities 94 and 96 goes completely around the inner and outer end portions 34 and 38 of each of the airfoils 24 so that the end portions of the airfoils are circumscribed by the molten metal. If a rail is provided on the inner shroud ring 26, the molten metal for forming the rail would engage the inner end surfaces of the airfoils.

Figure 8:
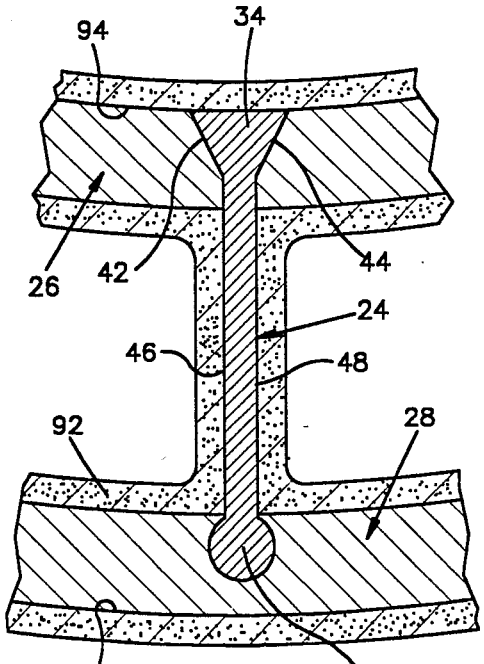
FIG. 8 is a fragmentary sectional view illustrating the relationship between the airfoil and metal cast in the shroud ring mold cavities of FIG. 7.

Once the molten metal has been poured, the airfoils act as a chill. Therefore, the molten metal solidifies in a direction extending transverse to the central axes of the airfoils 24. However, shrinkage defects are not formed in the axially upper and lower end portions of the inner and outer shroud ring mold cavities 94 and 96. This is because the runners 78 and 82 are effective to maintain a supply of molten metal to the shroud ring mold cavities 94 and 96 as the molten metal in the shroud ring mold cavities solidifies to form the shroud rings 26 and 28 (FIG. 8).

During solidification of the molten metal in the shroud ring mold cavities 94 and 96, a metallurgical bond does not form between the inner and outer shroud rings 26 and 28 and the end portions 34 and 38 of the airfoils 24. This is because the outer surfaces of the airfoils 24 are covered with an oxide coating which is formed during processing of the airfoils in the atmosphere. This oxide coating prevents the forming of a metallurgical bond between the airfoils 24 and the inner and outer shroud rings 26 and 28. Therefore, there is only a mechanical bond between the inner and outer shroud rings 26 and 28 and the end portions 34 and 38 of the airfoils 2.

The molten metal which solidifies to form the inner and outer shroud rings 26 and 28 has a different composition than the composition of the airfoils 24. Thus, the airfoils 24 are formed of a nickel-chrome alloy. The inner and outer shroud rings 26 and 28 are formed of cobalt chrome superalloy, such as MAR M509. Although the shroud rings 26 and 28 are formed of the same metal, they could be formed of different metals if desired. If the shroud rings 26 and 28 are to be formed of different metals, two separate gating systems would have to be provided, that is one gating system for the inner shroud ring mold cavity 94 and a second gating system for the outer shroud ring mold cavity 96. Of course, each gating system would have its own downpole and pour cup.

During solidification of the molten metal in the annular shroud ring mold cavities 94 and 96, the molten metal in the annular outer shroud ring mold cavity 96 solidifies first. As the molten metal in the outer shroud ring mold cavity 96 solidifies, it grips the bulbous outer end portion 38 (FIG. 8) of the airfoil 24 to firmly connect the airfoil with the outer shroud ring 28.

The annular body of metal in the inner shroud ring mold cavity 94 solidifies after the metal in the outer shroud ring mold cavity 96. After the molten metal in the inner shroud ring mold cavity 94 has almost solidified, the molten metal in gating system 68 solidifies sufficiently to apply thermal contraction forces to the metal in the inner shroud ring mold cavity 94. The thermal contraction or shrinkage forces 84 (FIG. 9) applied to the metal in the inner shroud ring mold cavity 94 by the metal in the gating system 68 is relatively large and is applied to the inner shroud ring at locations where runners 82 are connected with the annular inner shroud ring mold cavity 94.

The forces 84 applied to the inner shroud ring 26 as the metal in the gating system 68 cools and contracts, pull the not quite fully solidified inner shroud ring 26 radially inwardly. As the inner shroud ring 26 is pulled radially inwardly, the fully solidified metal of the outer shroud ring 28 holds the airfoils 24 against movement. Therefore, the not yet completely solidified metal of the inner shroud ring 26 moves radially inwardly relative to the annular inner end portions 34 of the airfoils 24.

As the metal forming the inner shroud ring 26 moves inwardly from the position shown in FIG. 8 to the position shown in FIG. 9, the inner end portion 34 of the airfoil 24 plastically deforms the hot and not yet fully solidified metal of the inner shroud ring 26 to form the cavities or spaces 52 (FIG. 9). As the metal of the inner shroud ring 26 is pulled inwardly, the ceramic mold material 92 yields somewhat along the major side surfaces 46 and 48 of the airfoils 24 and along surfaces of the inner shroud ring.

The distance through which the inner shroud ring 26 is pulled inwardly by thermal contraction of the metal in the gating system 68 is a function of the mass of the metal in the gating system. Thus, if it is desired to increase the radial extent of the cavities or spaces 52, the mass of metal in the gating system 68 would be increased. It should be understood that the distance through which the metal of the gating system 68 moves the metal of the inner shroud ring 26 is relatively small. Thus, the inner shroud ring 26 is usually moved in through a radial distance of approximately 0.025 inches. However, even this small movement forms the cavities 52 with a radial extent sufficient to accommodate thermal expansion of the airfoils 24. Of course, the cavities 52 in the shroud ring 26 of any specific turbine engine component will be formed with a radial extent sufficient to accommodate the thermal expansion of the particular airfoils used in that turbine engine component.

After the molten metal in the mold 60 has completely solidified, the mold material 92 is broken away from the metal. The gating system is then disconnected from the shroud rings 26 and 28. After the inner and outer shroud rings have been cleaned and any undesired projections removed, the resulting turbine engine component 20 is mounted in a turbine engine. Although the turbine engine component 20 could be used at various locations in an engine, it is believed that it will be used as a first stage stator.

During operation of the engine, the airfoils 24 are exposed to gas which comes directly from the combustion chamber of the engine. The airfoils 24 become hotter than the inner and outer shroud rings 26 and 28. Therefore, the airfoils 24 tend to expand along their longitudinal axes, that is in the radial direction relative to the shroud rings 26 and 28. In the absence of the slip joints 32 between the inner end portions 34 of the airfoils 24 and the inner shroud ring 26 (see FIG. 2), substantial thermal stresses would be set up in the airfoils and the inner and outer shroud rings 26 and 28.

As the airfoils 24 are heated to a temperature which is above the temperature of the inner and outer shroud rings 26 and 28 and expand relative to the inner and outer shroud rings, the inner ends 34 of the airfoils 24 move radially inwardly relative to the inner shroud ring 26. As this occurs, the inner ends 34 of the airfoils 24 move into the cavities 52 (FIG. 3). In the specific embodiment of the turbine component 20 illustrated in FIGS. 2 and 3, the airfoils 24 expand relative to the inner shroud ring 26 through a radial distance of less than 0.020 inches.

As the inner ends 34 of the airfoils move into the cavities 52, the outer side surfaces 42 and 44 on the inner ends 34 of the airfoils 24 move away from similarly tapering inner side surfaces 102 and 104 (FIG. 3) on the inside of openings formed in the inner shroud ring 26. Since there are no metallurgical bonds between the inner shroud ring 26 and the airfoils 24, the airfoils can be readily extended inwardly relative to the inner shroud ring. The lack of metallurgical bonds between the end portions 34 of the airfoils 24 and the inner shroud ring 26 is due to the oxide coatings which cover the end portions 34 of the airfoils 24 before the molten metal is poured into the shroud ring mold cavity. Since the outer end portion 38 of each of the airfoils 24 is mechanically anchored in the outer shroud ring 28, the airfoil 24 cannot move out of engagement with the outer shroud ring.

Although the slip joints 32 have been shown herein as being between the end portion 34 of the airfoil 24 and the outer shroud ring 26, it is contemplated that the slip joints could be provided between the outer end portion 38 of the airfoil 24 and the outer shroud ring 28. In the illustrated embodiment of the invention, the inner and outer shroud rings 26 and 28 are positioned in a concentric relationship with the airfoils 24 disposed in a radially extending annular array between the shroud sections. In certain known turbine engine components, the shroud rings have the same diameter and the airfoils extend in an axial direction between the shroud rings. Of course, these shroud rings could be cast around preformed airfoils in much the same way as in which the shroud rings 26 and 28 are cast around the airfoils 24. It is contemplated that suitable slip joints could also be provided between the airfoils and shroud rings in this type of turbine engine component.

In the turbine engine component 20, the shroud rings 26 and 28 are formed as continuous annular castings. However, the shroud rings 26 and 28 could be formed of interconnected arcuate sections if desired. Although it is preferred to move the inner shroud ring 26 relative to the airfoils 24 and outer shroud ring 28 to form the cavities 52, the airfoils 24 could be moved relative to the shroud rings to form the cavities.

Second Embodiment

Figure 10:
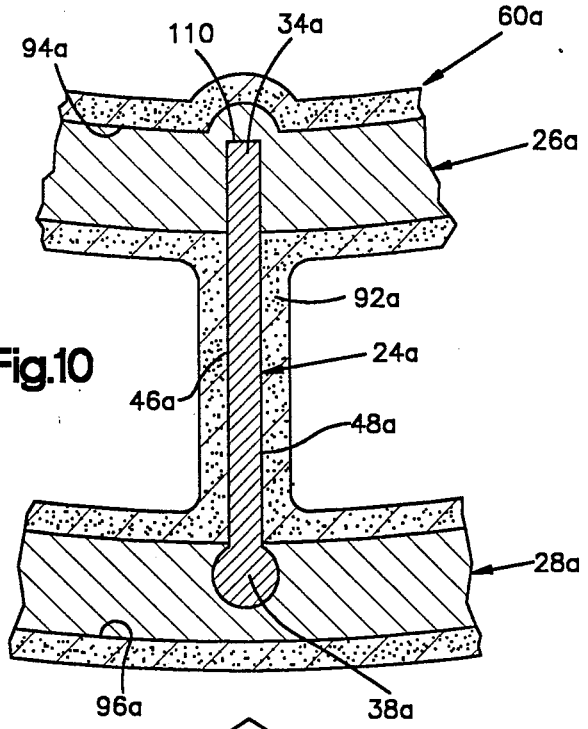
FIG. 10 is a fragmentary sectional view, generally similar to FIG. 8, of an embodiment of the invention in which the airfoils have straight end portions which are received in an annular shroud ring mold cavity.
Figure 11:
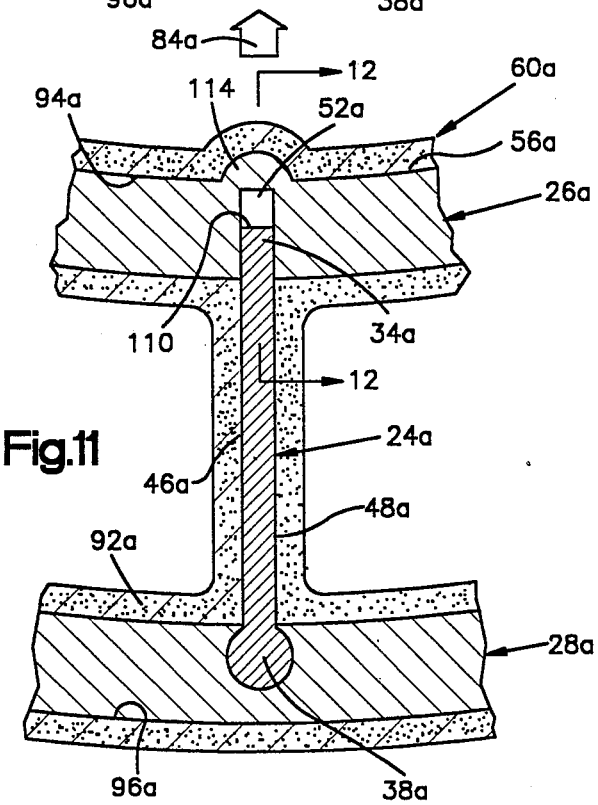
FIG. 11 is a fragmentary sectional view, generally similar to FIG. 9, schematically illustrating the manner in which a shroud ring is moved relative to the airfoil of FIG. 10 to form a closed-ended cavity in the shroud ring during contraction of metal in a mold gating system.
Figure 12:
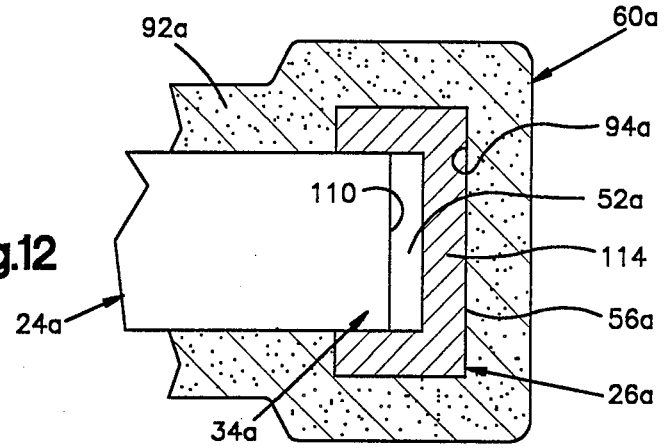
FIG. 12 is a fragmentary sectional view, taken generally along the line 12—12 of FIG. 11, illustrating the manner in which an end wall section completely closes one end of the cavity at the end of the airfoil.

In the embodiment of the invention illustrated in FIGS. 1–9, when the airfoils 24 are in an expanded condition relative to the shroud rings 26 and 28, as illustrated in FIG. 3, it is theoretically possible to have some slight leakage of gas through the open-ended cavities 52. In the embodiment of the invention illustrated in FIGS. 10–12, there are no openings in the inner side surface of the inner shroud ring. Thus, the radially inner ends of shroud ring cavities are completely blocked. Therefore, it is impossible for gas to leak, in a radial direction through the inner shroud ring under any operating condition. Since the embodiment of the invention illustrated in FIGS. 10–12 is generally similar to the embodiment of the invention illustrated in FIGS. 1–9, similar numerals will be utilized to designate similar components, the suffix letter "a" being added to the numerals of FIGS. 10–12 to avoid confusion.

An annular array of airfoils **24*a* extend between annular shroud ring mold cavities 94*a* and 96*a*. The airfoils 24*a* have straight inner end portions 34*a* which are received in an annular inner shroud ring mold cavity 94*a*. The inner end portions 34*a* of the airfoils 24*a* are spaced apart from the mold material 92*a*. Therefore, prior to pouring of the molten metal into the mold 60*a*, there is space between all of the surfaces of the inner end portions 34*a* of the airfoils 24*a* and the inner side surfaces of the inner shroud ring mold cavity 94*a*. The outer end portions 38*a* of the airfoils 24*a* are disposed in the outer shroud ring mold cavity 96*a* and are spaced from the surfaces of the outer shroud ring mold cavity. If desired, space could be provided in the inner and/or outer shroud ring mold cavities 94*a* and 96*a*** to form one or more annular rails.

The mold **60*a* is formed in the same manner as previously described in conjunction with the mold 60 of FIGS. 1–9. When molten metal is poured into the mold 60*a*, the molten metal enters the annular inner shroud ring mold cavity 94*a* and the annular outer shroud ring mold cavity 96*a*. The molten metal in the inner shroud ring mold cavity 94*a* completely encloses the inner end portions 34*a* of the airfoils 24*a*. Thus, all of the surfaces on the inner end portions 34*a* of the airfoils 24*a*** are engaged by molten metal.

The molten metal in the annular inner shroud ring mold cavity **94*a* extends across radially inner end surfaces 110 of the airfoils 24*a*. The molten metal completely fills the space between the inner end portions 34*a* of the airfoils 24*a* and the circular inner side surface of the annular inner shroud ring mold cavity 94*a*. Thus, the inner end portions 34*a*-of the airfoils 24*a* do not engage the ceramic mold material 92*a* except at the locations where the airfoils project through the radially outer wall of the inner shroud ring mold cavity 94*a***.

The molten metal in the annular outer shroud ring mold cavity **96*a* solidifies before the molten metal in the annular inner shroud ring mold cavity 94*a*. The outer end portions 38*a* of the airfoils 24*a* are firmly gripped by the solidified metal in the outer shroud ring mold cavity 96*a*. Therefore, the outer shroud ring 28*a* grips the bulbous outer end portions 38*a* of the airfoils 24*a* to hold the airfoils against movement relative to the outer shroud ring 28*a***.

After the molten metal in the outer shroud ring mold cavity **96*a* has solidified, the molten metal in the inner shroud ring mold cavity 94*a* solidifies. After molten metal in the inner shroud ring mold cavity 94*a* has almost completely solidified, the molten metal in the gating system (not shown) for the inner shroud ring mold cavity 94*a* solidifies. As the molten metal in the gating system solidifies, the gating system contracts and applies radially inwardly directed forces, indicated schematically at 84*a* in FIG. 11, to the inner shroud ring 26*a*. The inner shroud ring 26*a* is pulled radially inwardly relative to the airfoil 24*a*** and outer shroud ring 28a by the forces 84a in the same manner previously explained for the embodiment of the invention illustrated in FIGS. 1–9.

As the almost completely solidified metal in the annular inner shroud ring mold cavity 94a is pulled radially inwardly by the gating system, the metal moves from the position shown in FIG. 10 to the position shown in FIG. 11. As this occurs, closed-ended cavities or spaces 52a are formed within the inner shroud ring 26a. Thus, the cast cavities 52a are formed in the inner shroud ring 26a during the final stages of solidification of the molten metal in the inner shroud ring mold cavity 94a.

The radially inner ends of the as cast cavities 52a are completely blocked by cast, imperforate end wall sections 114 which extend across the ends of the airfoils 24a (FIGS. 11 and 12). Thus, the generally cylindrical inner side surface 56a (FIG. 11) of the inner shroud ring 26a is free of openings to the as cast cavities or spaces 52a. The airfoils 24a extend through the only openings to the cavities 52a. Therefore, it is impossible, under any engine operating conditions, to have a flow of gas in a radial direction through the inner shroud ring 26a.

During the use of a turbine engine component of FIGS. 10–12, the airfoils 24a are exposed to gas and become hotter than the inner and outer shroud rings 26a and 28a. Therefore, the airfoils 24a tend to expand axially outwardly, that is in a radial direction relative to the annular shroud rings 26a and 28a. Since the outer end portions 38a of the airfoils 24a are firmly held by the continuous outer shroud ring 28a, the inner end portions 34a of the airfoils expand into the closed-ended cavities 52a.

There are no metallurgical bonds between the inner end portions 34a of the airfoils 24a and the inner shroud ring 26a. Therefore, the airfoils 24a are free to expand in a radially inward direction relative to the inner shroud ring 26a. As the airfoils expand, the radial extent of the cavities 52a is reduced.

The radial extent of the cavities 52a is sufficient to accommodate the maximum thermal expansion of the airfoils 24a relative to the inner shroud ring 26a during operation of the engine. In one specific embodiment of the invention, it is contemplated that the airfoils 24a will expand in a radial direction relative to the inner shroud ring 26a through a distance which is less than 020 inches. The distance between the radially innermost end surface 110 of the airfoil 24a and a radially outer side surface of the end wall section 114 (FIG. 12) is 0.020 to 0.025 inches when the airfoil 24a and a radially outer side surface of the end wall section 114 (FIG. 12) is 0.020 to 0.025 inches when the airfoils 24a and shroud rings 26a and 28a are at ambient temperature prior to operation of an engine. Therefore, the radial extent of the cavities 52a is more than sufficient to accommodate the thermal expansion of the airfoils 24a. Of course, the amount of expansion of the airfoils 24a and, therefore, the radial extent of the cavities 52a, may be different for components intended for use in different turbine engines.

The imperforate, cast end wall sections 114 span the radially inner end portions 34a of the airfoils 24a and completely block the inner ends of the cavities 52a. Therefore, gas cannot flow through the closed-ended cavities 52a during operation of a turbine engine. In addition to blocking gas flow, the end wall sections 114 span the ends of the airfoils 24a to transmit forces between portions of the inner shroud ring 26a disposed on opposite sides of the airfoils. This reinforces the inner shroud ring 26a to prevent deformation of the shroud ring under the influence of forces applied against the shroud ring by the airfoils 24a during operation of an engine.

In the embodiment of the invention illustrated in FIGS. 10–12, the ends 34a of the airfoils 24a are straight, that is they have no taper. It is contemplated that it may be desirable to provide the airfoils with some taper. Although the inner ends 34a of the airfoils 24a could be tapered to the same extent as the inner ends 34 of the airfoils 24 of FIGS. 1–9, it is preferred to taper the ends of the airfoils 24a by 2° or less. Although the cavities 52a have been described herein as being formed in the inner shroud ring 26a, they could be formed in the outer shroud ring 28a if desired.

In the embodiment of the invention illustrated in FIGS. 10–12, the inner shroud ring 26a does not have a rail. However, it is contemplated that the inner shroud ring could be provided with one or more annular rails. Each of the airfoils 24a may be covered by a thin wax coating prior to formation of the mold 60a to provide space to accommodate thermal expansion of the airfoils, in the manner previously explained in conjunction with the embodiment of the invention illustrated in FIGS. 1–9.

Third Embodiment

In the embodiment of the invention illustrated in FIGS. 10–12, the end wall sections 114 completely block the radially inner ends of the closed-ended cavities 52a. In the embodiment of the invention illustrated in FIG. 13, the end wall sections do not completely block the ends of the cavities in which the airfoils are received. Since the embodiment of the invention illustrated in FIG. 13 is generally similar to the embodiments of the invention illustrated in FIGS. 1–12, similar numerals will be utilized to designate similar components, the suffix letter "b" being added to the numerals of FIG. 13 in order to avoid confusion.

Figure 13:
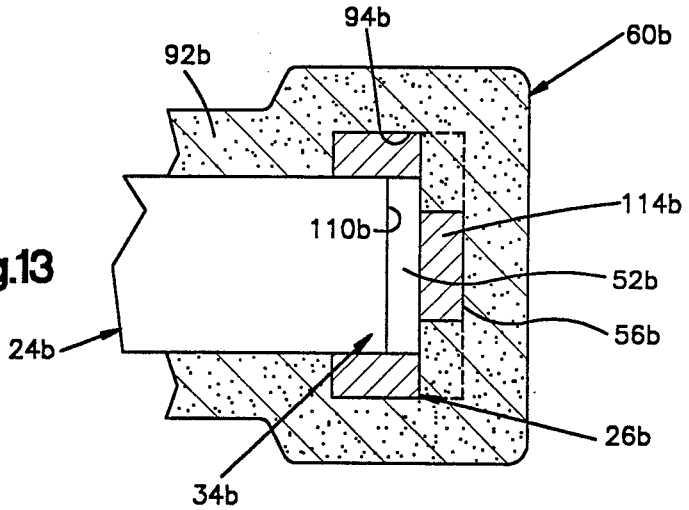
FIG. 13 is a fragmentary sectional view, generally similar to FIG. 12, of an embodiment of the shroud ring in which a partially closed-ended cavity receives one end of the airfoil and an end wall section spans the end of the airfoil to prevent deformation of the shroud ring.

In the embodiment of the invention illustrated in FIG. 13, the end wall sections 114b span the inner end portions 34b of the airfoils 24b. However, the inner end wall sections 114b do not completely block the cavities 52b. Thus, the end wall sections 114b extend across the ends of the airfoils 24b at the centers of the airfoils and have a width which is less than the width of the airfoils. The end wall sections 114b extend through the longitudinal central axes of the airfoils 24b. This enables the end wall sections 114b to transmit force between opposite sides of the airfoils 24b to prevent deformation of the annular inner shroud ring 26b.

Although the end wall sections 114b are effective to reinforce the shroud ring 26b and prevent deformation of the shroud ring, the end wall sections 24b do not completely block the radially inner ends of the cavities 52b. Thus, there are openings on opposite sides of the end wall section 114b.

Prior to formation of the partially closed-ended cavities 52b, that is before the molten metal in the gating system for the mold 60b solidifies to pull the inner shroud ring 26b radially inwardly, the inner end surface 110b of the airfoil 24b is engaged by the metal of the end wall section 114b. In addition, the ceramic mold material 92b engages the end surface 110b of the airfoil 26b on opposite sides of the end wall section 114b.

When the almost completely solidified metal in the shroud ring 26b is pulled radially inwardly by thermal contraction of the gating system in the manner previously explained, the mold material 92b and the metal of the end wall section 114b both move out of engagement with the inner end surface 110b of the airfoil 24b. As the inner shroud ring 26b is pulled inwardly by contraction of the gating system, the fully solidified metal of the outer shroud ring (not shown) grips the outer ends of the airfoils to hold them against movement. Inward movement of the inner shroud ring 26b relative to the airfoils 24b and outer shroud ring results in the formation of the partially closed-ended cavities 52b. The radial extent of the cavities or spaces 52b is more than sufficient to accommodate the maximum expected thermal expansion of the airfoil 24b relative to the inner shroud ring 26b.

The shroud ring 26b could be provided with one or more annular rails if desired. It is contemplated that an annular cylindrical rail could project radially inwardly from the end wall section 114b.

Fourth Embodiment

In the embodiment of the invention illustrated in FIGS. 1–13, the cavities at the ends of the airfoils are formed by pulling the inner shroud ring radially inwardly with the gating system during the final stages of solidification of the metal in the inner shroud ring mold cavity. Therefore, the radial extent of the as cast cavities in the inner shroud ring is determined by the distance through which the inner shroud ring is pulled inwardly by the gating system. In the embodiment of the invention illustrated in FIG. 14, the cavities in the inner shroud ring adjacent to the ends of the airfoils have an extent which is greater than the distance which the material of the inner shroud ring is pulled inwardly by contraction of the gating system. Since the embodiment of the invention illustrated in FIG. 14 is generally similar to the embodiments of the invention illustrated in FIGS. 1–13, similar numerals will be utilized to designate similar components, the suffix letter "c" being added to the numerals of FIG. 14 in order to avoid confusion.

Figure 14:
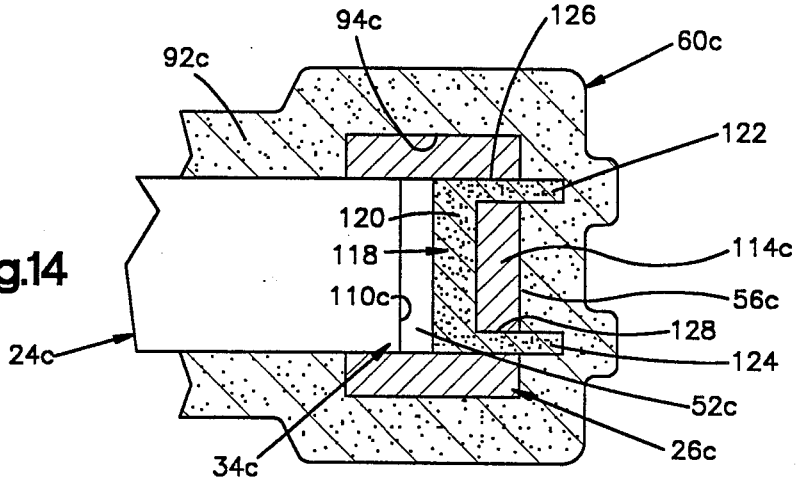
FIG. 14 is a fragmentary sectional view, generally similar to FIGS. 12 and 13, illustrating an embodiment of the invention in which core material is disposed at one end of an airfoil to partially form a cavity in a shroud ring.

In accordance with a feature of the embodiment of the invention illustrated in FIG. 14, core material 118 is disposed at the radially inner end portions of the airfoils 24c. The core material 118 is preformed as a separate body which is connected to the end surfaces 110c of an airfoils 24c. However, the core material 118 could be molded in place at or painted on the end portions 34c of the airfoils 24c if desired.

When the mold 60c is to be formed, the core material 118 is first connected to the end surfaces 110c of an airfoils 24c. The shroud ring pattern material is then formed (injected) around the radially inner end portions 34c of the airfoil and the core material 118. Of course, shroud ring pattern material is also formed around the outer ends of the airfoils 24c in the manner previously explained in conjunction with the embodiment of the invention illustrated in FIGS. 1–9.

The core material 118 includes a main or body section 120. The body section 120 of the core material 118 has the same cross sectional configuration as the airfoil 24c so that the body of core material forms an extension of the airfoil. A pair of support sections 122 and 124 extend outwardly from the body section 120 of core material.

The ceramic core material 118 may be of any one of many known desired compositions, such as the compositions disclosed in U.S. Pat. Nos. 4,093,017; 4,097,292; 4,164,424; 4,190,450; or 4,236,568. It should be understood that the specific composition of the core material 118 is not, per se, a feature of the present invention and that any desired core material may be used.

In order to form the mold 60c, the entire pattern assembly, that is, the airfoils 24c, inner and outer shroud ring patterns and the core material 118, is completely covered with liquid ceramic mold material. This may be accomplished by dipping the pattern assembly in liquid ceramic mold material. The wet ceramic mold material engages the radially inner end portions of the support sections 122 and 124. However, the body section 120 and radially outer end portions of the support sections 122 and 124 of the core material 118 are enclosed by the inner shroud ring pattern material and are not engaged by the wet ceramic mold material.

After the ceramic mold material has dried, or at least partially dried, the wax material forming the inner and outer shroud ring patterns is removed from the mold 60c to leave the annular inner shroud ring mold cavity 94c (FIG. 14) and an annular outer shroud ring mold cavity (not shown). At this time, the core material 118 is supported in the shroud ring mold cavity 94c by the end portion 34c of the airfoil 24c and the ceramic mold material 92c. Thus, the inner end portions of the support sections 122 and 124 of the core material 118 are gripped by the ceramic mold material 92c. Force is transmitted between the core material 118 and the airfoil 24c and between the core material and the mold material 92c to support the core material. There is space between the body 120 of the core material 118 and the ceramic mold material 92. This space extends across the end of the airfoil 24c at a location between the support sections 122 and 124 of the core material 118.

After the wax material forming the inner and shroud ring patterns has been removed, the mold 60c is heated. During heating, the airfoil 24c expands relative to the ceramic mold material 92c. This thermal expansion of the airfoil 24c breaks the bond between the core material 118 and the end portions 34c of the airfoils 24c. However, the core material is held against movement relative to the mold cavity 94c by the support sections 122 and 124.

After the mold 60c has been heated, molten metal is poured into the mold. The molten metal is conducted by suitable gating (not shown) into annular inner and outer shroud ring mold cavities to form annular shroud rings with an annular array of airfoils 24c extending between the shroud rings. During pouring, the molten metal engages the core material 118. The core material 118 is firmly held against movement relative to the shroud ring mold cavity 94c by the support sections 122 and 124. Thus, the ceramic mold material 92c grips the support sections 122 and 124 to hold the core material 118 in place.

The shroud ring 26c encloses the inner end portions 34c of the airfoils 24c and the main body 120 of the ceramic core material. The molten metal of the shroud ring 26c extends across the ends of the airfoils 24c in the space between the bodies 120 of core material 118 and a circular inner mold surface to form the end wall section 114c.

After the molten metal in the outer shroud ring mold cavity has solidified, the molten metal in the inner shroud ring mold cavity 94c solidifies. After the molten metal in the inner shroud ring mold cavity 94c has almost solidified, the molten metal in the gating system solidifies. As the metal in the gating system solidifies, it contracts.

When the metal in the gating system contracts and pulls the annular inner shroud ring 26c radially inwardly, the core material 118 moves with the mold material 92c and separates from the end surface 110c of the airfoil 24c, in the manner shown in FIG. 14. The contraction of the metal in the gating system applies radially inwardly directed forces, corresponding to the forces 84 of FIG. 9. These forces move the metal of the inner shroud ring to initially form the cavity or space 52c between the end surface 110 of the airfoil 24c and the core material 118 in the manner previously explained in conjunction with the embodiment of the invention illustrated in FIGS. 1–9.

Once the metal in the mold 60c has solidified, the mold material 92c is removed and the core material 118 is removed from the cavity 52c. The core material 118 is removed through openings 126 and 128 formed in the cast inner wall section 114c of the shroud ring 26c by the core material support sections 122 and 124. Since there are a pair of openings 126 and 128, a flow of fluid can be induced through the mold cavity 52c to completely clean the core material 118 out of the cavity 52c.

After the core material 118 has been completely removed from the cavity 52c, the cavity or space will have a radial extent equal to the sum of the distance which the shroud ring 26c is moved inwardly by contraction of the metal in the gating system and the radial extent of the body 120 of core material. Of course, the radial extent of the body of core material can be selected to provide the cavity 52c with any desired radial dimension and/or configuration. Once the core material has been removed from the cavity 52c, the openings 126 and 128 are blocked or plugged so that the cavity 52c is completely closed-ended. Of course, if desired, the openings 126 and 128 could be left open so that the cavity 52c would be only partially closed-ended.

After the openings in the end wall section 114c have been blocked, the turbine engine component is mounted in an engine. During operation of the engine, the airfoils 24c are exposed to gas which comes directly from the combustion chamber of the engine. The airfoils 24c become hotter than the inner and outer shroud rings. Therefore, the airfoils 24c tend to expand along their longitudinal axes, that is in the radial direction relative to the inner shroud ring 26c. In the absence of slip joints between the inner end portions 34c of the airfoils 24c and the inner shroud ring 26c, substantial thermal stresses would be set up in the airfoils and the inner and outer shroud rings.

As the airfoils 24c are heated to a temperature which is above the temperature of the inner and outer shroud rings and expand relative to the inner and outer shroud rings, the inner ends 34c of the airfoils 24c move radially inwardly relative to the inner shroud ring 26c. As this occurs, the inner ends 34c of the airfoils 24c move into the closed-ended cavities 52c. Since the closed-ended cavities 52c have a relatively large radial extent due to the combined effects of moving the inner shroud ring 26c radially inwardly relative to the airfoils 24c and removing the core material 118, the airfoils 24c can expand through a relatively large distance relative to the shroud rings. By properly sizing the core material 118, the closed-ended cavity 52c can be sized to accommodate any desired radial expansion of the airfoil 24c. In fact, the closed-ended cavity could be entirely formed by removing the core material 118.

Although the cavities 52c have been shown as being in the inner shroud ring 26c, the cavities could be in the outer shroud ring if desired. In the embodiment of the invention described herein, the cavities 52c are formed by moving the inner shroud ring 26c relative to the airfoils 24c and by removing core material 118 from the shroud ring. However, the cavities 52c could be completely formed by removing core material from the shroud ring if desired.

The embodiment of the shroud ring illustrated in FIG. 14 does not have a rail. However, one or more rails could be provided on the inner shroud ring. At least one or more rails could project radially inwardly from the inner wall section 114c if desired.

Fifth Embodiment

In the embodiments of the invention illustrated in FIGS. 1–14, the shroud rings have not been shown with rails, even though it is contemplated that the inner and/or outer shroud rings could be formed with one or more rails if desired. In the embodiment of the invention illustrated in FIGS. 15 and 16, the inner shroud ring is provided with a rail. In addition, closed-ended cavities are disposed in the shroud ring to receive ends of the airfoils. Thus, the radially inner ends of the airfoil receiving cavities in the inner shroud ring are completely blocked by cast imperforate end walls disposed at the ends of the cavities opposite from openings through which the airfoils extend. Since the embodiment of the invention illustrated in FIGS. 15 and 16 is generally similar to the embodiment of the invention illustrated in FIGS. 1–14, similar numerals will be utilized to designate similar components, the suffix letter "d" being added to the numerals of FIGS. 15 and 16 to avoid confusion.

An annular array of airfoils 24d extend between annular shroud ring mold cavities 94d and 96d. The airfoils 24d have straight inner end portions 34d which are received in an annular inner shroud ring mold cavity 94d. Although the inner end portions 34d of the airfoils 24d have been illustrated as being straight, it is contemplated that the end portions of the airfoils could taper inwardly, in a manner similar to that shown in FIGS. 2 and 3. Although the airfoils 24d of FIGS. 2 and 3 have a relatively large taper, it is contemplated that the airfoils 24d may be formed with a taper of only 2 or 3 degrees.

The inner end portions 34d of the airfoils 24d are spaced from the radially inner wall of the shroud ring mold cavity 94e. The only place where the airfoils 24d engage the ceramic mold material 92d forming the inner shroud ring mold cavity 94d is where the airfoils extend through the radially outer wall of the mold cavity. Therefore, prior to pouring of molten metal into the mold 60d, there is a space between the surfaces of the inner end portions 34d of the airfoils 24d and the inner side surfaces of the inner shroud ring mold cavity 94d. The outer end portions 38d of the airfoils are disposed in the outer shroud ring mold cavity 96d and are spaced from the surfaces of the outer shroud ring mold cavity.

Figure 15:
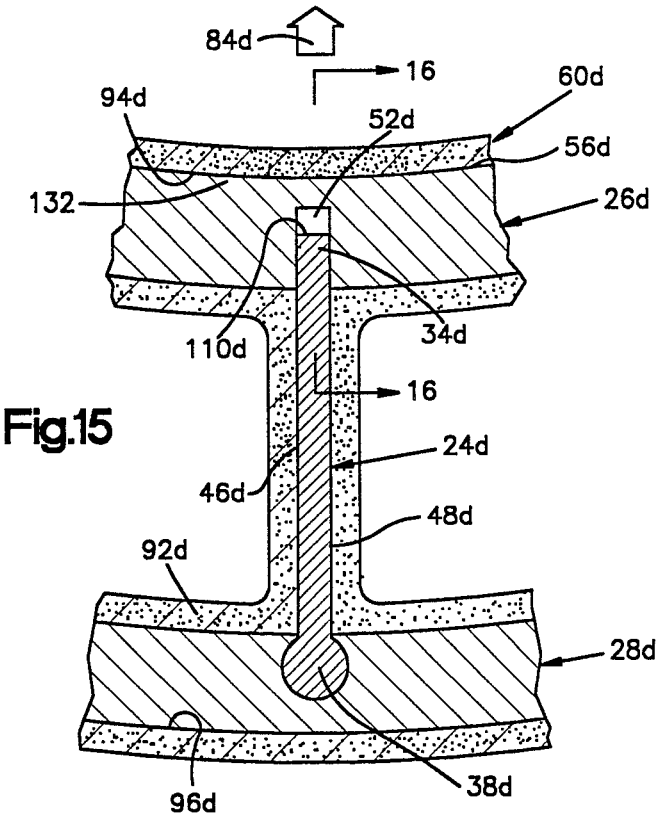
FIG. 15 is a fragmentary sectional view, generally similar to FIG. 11, of an embodiment of the invention in which the inner shroud ring is provided with a rail and in which closed-ended cavities are formed in the shroud ring.
Figure 16:
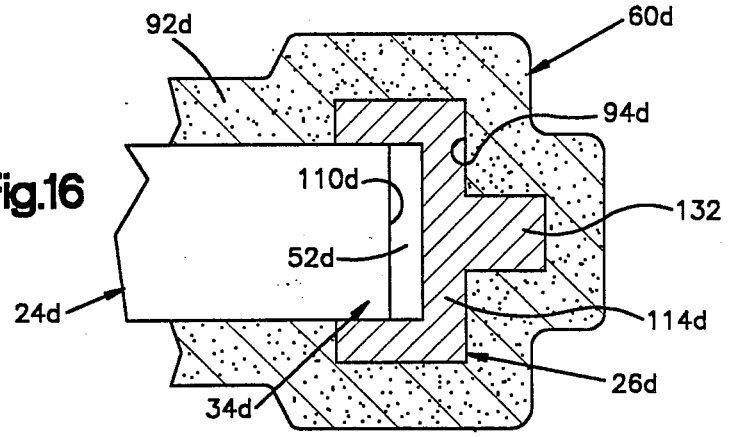
FIG. 16 is a fragmentary sectional view, taken generally along the line 16—16 of FIG. 15, illustrating the manner in which an end wall section completely closes one end of the cavity at the end of the airfoil and illustrating the cross sectional configuration of the rail.

In accordance with a feature of the embodiment of the invention illustrated in FIGS. 15 and 16, the inner shroud ring 26d is provided with an annular radially inwardly projecting rail 132 (FIG. 16). The shroud ring rail 132 facilitates mounting of the turbine engine component and strengthens the turbine engine component. Although a shroud ring rail 132 has been shown on only the inner shroud ring 26d, it is contemplated that a shroud ring rail could be provided on the outer shroud ring 28d. The rail 132 is disposed radially inwardly of a central portion of each of the airfoils 24d (FIG. 16). It should be understood that rails, similar to the rail 132, could be provided on the inner shroud ring 26 of FIGS. 2 and 3 and would span the ends of the airfoils. There will be no interference between the airfoils 24 (FIGS. 2 and 3) and the shroud ring since the cavities 52 at the ends of the airfoils 24 of FIGS. 2 and 3 have a radial extent sufficient to accommodate thermal expansion of the airfoils.

The mold 60d is formed in the same manner as previously described in conjunction with the embodiment of the invention illustrated in FIGS. 1–14. As described in conjunction with the embodiment of the invention illustrated in FIGS. 1–14, the airfoils 24d may be covered with a thin wax coating prior to formation of the mold 60d. During dewaxing, this thin covering is removed to provide space which accommodates thermal expansion of the airfoils 24d during preheating of the mold and/or casting of molten metal in the mold. If the airfoils 24d are relatively small and/or the mold material has sufficient elasticity to accommodate the thermal expansion of the airfoils, the thin wax coating may be eliminated.

When molten metal is poured into the mold 60d, the molten metal enters the annular inner shroud ring mold cavity 94d and the annular outer shroud ring mold cavity 96d. The molten metal in the inner shroud ring mold cavity 94d completely encloses the inner end portions of the airfoils 24d and fills the portion of the inner shroud ring mold cavity in which the rail 132 is to be cast. Thus, all of the surfaces on the inner end portions 34d of the airfoils 24d are engaged by the molten metal.

The molten metal in the annular inner shroud ring mold cavity 94d extends across radially inner end surfaces 110d of the airfoils 24d. The molten metal surrounds the inner end portions 34d of the airfoils 24d and completely fills the space between the inner end portions of the airfoils and the circular inner side surface of the annular inner shroud ring mold cavity 94d. Thus, the inner end portions 34d of the airfoils 24d do not engage the ceramic mold material 92d except at locations where the airfoils project through the radially outer wall of the inner shroud ring mold cavity 94d.

Molten metal in the annular outer shroud ring mold cavity 96d solidifies before the molten metal in the annular inner shroud ring mold cavity 94d. The outer end portions 38d of the airfoil 24d are firmly gripped by the solidified metal in the outer shroud ring mold cavity 96d. Therefore, the outer shroud ring 28d grips the bulbous outer end portions 38d of the airfoils 24d to hold the airfoils against movement relative to the outer shroud ring 28d.

After the molten metal in the outer shroud ring mold cavity 96d has solidified, the molten metal in the inner shroud ring mold cavity 94d solidifies. After the molten metal in the inner shroud ring mold cavity 94d has almost completely solidified, the molten metal in the gating system (not shown) for the inner shroud ring mold cavity 94d solidifies. The gating system is connected with the inner shroud ring mold cavity 94d through the space in which the rail 132 is formed. Thus, the gating system is connected with the inner shroud ring mold cavity 94d at locations where the rail forming portion of the inner shroud ring mold cavity projects radially inwardly. As the molten metal in the gating system solidifies, the gating systems contracts and applies radially inwardly directed forces, indicated schematically at 84d in FIG. 15, to the inner shroud ring 24d. The inner shroud ring 24d is pulled radially inwardly relatively to the airfoils 24d and the outer shroud ring 28d by the forces 84d in the same manner as previously explained for the embodiment of the invention illustrated in FIGS. 1–14.

As the completely solidified metal in the annular inner shroud ring mold cavity 94d is pulled radially inwardly by the gating system, the metal in the inner shroud ring mold cavity, including the metal forming the rail, moves inwardly away from the inner end portions 34d of the airfoils 24d. As this occurs, closed-ended cavities or spaces 52d are formed within the inner shroud ring 26d. The radially inner ends of the cavities 52d are completely blocked by cast, imperforate end wall sections 114d which extend across the ends of the airfoils 24d (FIGS. 15 and 16). Thus, the generally cylindrical inner side surface 56d of the shroud ring and the rail 132 is free of openings to the cavities or spaces 52d. The airfoils 24d extend through the only openings to the cavities 52d. Therefore, it is impossible, under any engine operating conditions, to have a flow of gas in a radial direction through the inner shroud ring 26d.

During the use of a turbine engine component constructed as shown in FIGS. 15 and 16, the airfoils 24d are exposed to gas and become hotter than the inner and outer shroud rings 26d and 28d. Therefore, the airfoils 24d tend to expand axially outwardly, that is in a radial direction relative to the annular shroud rings 26d and 28d. Since the outer end portions 38d of the airfoils are firmly held by the continuous outer shroud ring 28d, the inner end portions 34d of the airfoils expand into the closed-ended cavities 52d.

There are no metallurgical bonds between the inner end portions 34d of the airfoils 24d and the inner shroud ring 26d. Therefore, the airfoils 24d are free to expand in a radially inward direction relative to the inner shroud ring 26d. As the airfoils expand, the radial extent of the cavities 52d is reduced.

The radial extent of the cavities 52d is sufficient to accommodate the maximum thermal expansion of the airfoils 24d relative to the inner shroud ring 26d during operation of the engine. In one specific embodiment of the invention, it is contemplated that the airfoils 24d will expand in a radial direction relative to the inner shroud ring 26d through a distance which is less than 0.020 inches. The distance between the radially innermost end surface 110d of the airfoil 24d and an imperforate radially outer side surface of the end wall section 114d is 0.020 to 0.025 inches when the airfoils 24d and shroud rings 26d are at ambient temperature prior to operation of the engine. Therefore, the radial extent of the cavities 52d is more than sufficient to accommodate the thermal expansion of the airfoils 24d. Of course, the amount of the expansion of the airfoils 24d and, therefore, the radial extent of the cavities 52d may be different for components intended for use in different turbine engines.

The imperforate, cast end wall sections 114d span the radially inner end portions 34d of the airfoils 24d and completely block the inner ends of the cavities 52d. Therefore, gas cannot flow through the closed-ended cavities 52d during operation of the turbine engine. In addition to blocking gas flow, the end wall sections 114d span the ends of the airfoils 24d to transmit forces between portions of the inner shroud ring 26d disposed on opposite sides of the airfoils. Thus, both the end wall sections 114d and the annular rail 132 reinforce the inner shroud ring 26d to prevent deformation of the shroud ring under the influence of forces applied against the shroud ring by the airfoils 24d during operation of an engine.

Sixth Embodiment

In the embodiments of the invention illustrated in FIGS. 15 and 16, the cavities at the ends of the airfoils are formed by pulling the inner shroud ring radially inwardly with the gating system during the final stages of solidification of the metal in the inner shroud ring mold cavity. Therefore, the radial extent of the as cast cavities in the inner shroud ring is determined by the distance through which the inner shroud ring is pulled inwardly by the gating system. In the embodiment of the invention illustrated in FIG. 17, the cavities in the inner shroud ring adjacent to the ends of the airfoils have an extent which is greater than the distance which the material of the inner shroud ring is pulled inwardly by contraction of the gating system. In addition, in the embodiment of the invention illustrated in FIG. 17, there are no openings in the inner side wall of the inner shroud ring and a rail is provided on the inner shroud ring as previously described in connection with the embodiment of the invention illustrated in FIGS. 15 and 16. Since the embodiment of the invention illustrated in FIG. 17 is generally similar to the embodiments of the invention illustrated in FIGS. 1–16, similar numerals will be utilized to designate similar components, the suffix letter "e" being added to the numerals of FIG. 17 to avoid confusion.

Figure 17:
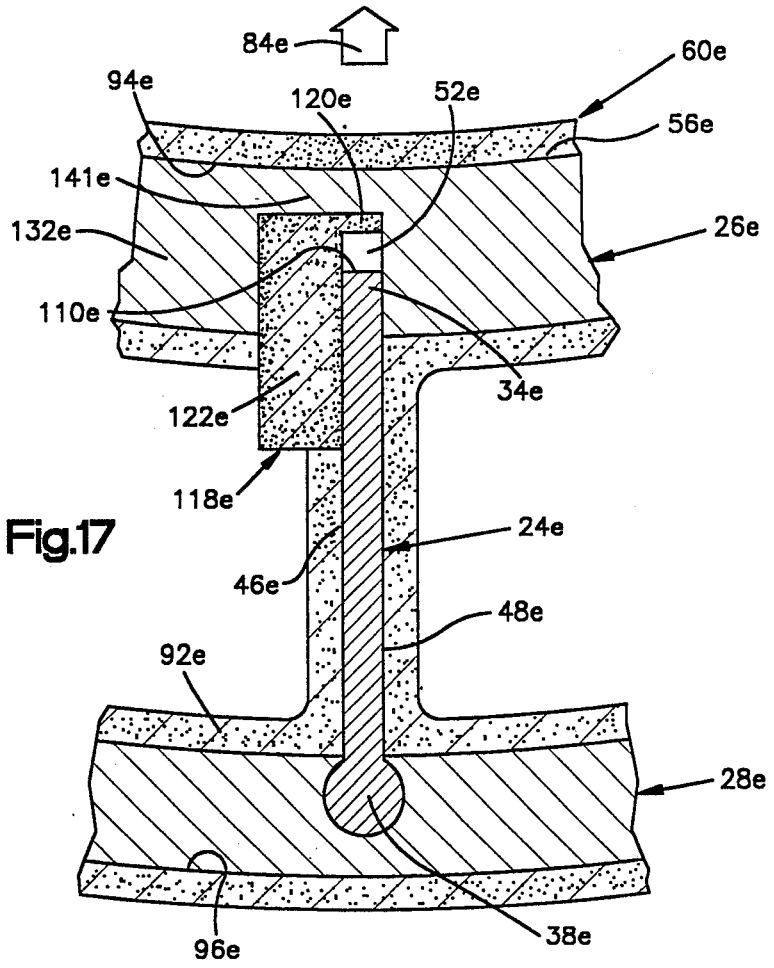
FIG. 17 is a fragmentary sectional view, generally similar to FIG. 15, of an embodiment of the invention in which core material is disposed at one end of an airfoil to form a close-ended cavity in a shroud ring having a rail.

In accordance with a feature of the embodiment of the invention illustrated in FIG. 17, core material 118e is disposed at the radially inner end portions of the airfoils 24e. The core material 118e is preformed as separate bodies which are connected to the end surfaces 110e of the airfoils 24e. However, the core material 118e could be molded in place at or painted on the end portions 34e of the airfoils 24e if desired.

When the mold 60e is to be formed, the core material 118e is first connected to the end surfaces 110e of the airfoils 26e. The shroud ring pattern material is then formed (injected) around the radially inner end portions 34e of the airfoils and the core material 118e. The shroud ring pattern material includes an annular inwardly projecting portion having a configuration corresponding to the configuration of the annular rail 132e. Of course, shroud ring pattern material is also formed around the outer ends 38e of the airfoils 24e in the manner previously explained in conjunction with the embodiment of the invention illustrated in FIGS. 1–9. A thin layer of pattern material is provided over the airfoils 24e to provide space to accommodate thermal expansion of the airfoils.

The core material 118e includes a main or body section 120e. The body section 120e of the core material 118e has the same cross sectional configuration as the airfoil 24e so that the body section 120e forms an extension of the airfoil. A support section 122e extends radially outwardly from the body section 120e.

In order to form the mold 60e, the entire pattern assembly, that is the airfoils 24e, inner and outer shroud ring patterns and the core material 118e is completely covered with liquid ceramic mold material. This may be accomplished by dipping the pattern assembly in liquid ceramic mold material. The wet ceramic mold material engages the support section 122e. However, the body section 120e and the radially inner portion of the support section 122e of the core material 118e are enclosed by the inner shroud ring pattern material and are not engaged by the wet ceramic mold material.

After the ceramic mold material has dried or at least partially dried, the wax material forming the inner and outer shroud ring patterns is removed from the mold 60e to leave the annular inner shroud ring mold cavity 94e (FIG. 17) and an annular outer shroud ring mold cavity 96e. At this time, the core material 118e is supported in the shroud ring mold cavity 94e by the end portion 34e of the airfoil 24e and the ceramic mold material 92e. Thus, the radially outer support section 122e of the core material 118e is gripped by the ceramic mold material 92e. Force is transmitted between the core material 118e and the airfoil 24e and between the core material and the mold material 92e to support the core material. There is space between the body 120e of the core material 118e and the ceramic mold material 92e. This space extends across the end 34e of the airfoil 24e at a location radially inwardly of the body 120e of core material. Unlike the embodiment of the invention illustrated in FIG. 14, the body 118e of core material is spaced apart from the radially inner wall of the shroud ring mold cavity 94e.

After the wax material forming the inner and outer shroud ring patterns has been removed, the mold 60e is heated. During heating, the airfoil 24e expands relative to the ceramic mold material 92e. This thermal expansion of the airfoil 24e breaks the bond between the core material 118e and the end portions 34e of the airfoils 24e. However, the core material 118e is held against movement relative to the mold cavity 94e by the support section 122e.

After the mold 60e has been heated, molten metal is poured into the mold. The molten metal is conducted by suitable gating (not shown) into annular inner and outer shroud ring mold cavities 94e and 96e to form annular shroud rings 26e and 28e with an annular array of airfoils 24e extending between the shroud rings. During pouring, the molten metal engages the core material 18e. The core material 18e is firmly held against movement relative to the shroud ring mold cavity 94e by the support section 122e. Thus, the ceramic mold material 92e grips the support section 122e to hold the core material 118e in place.

The shroud ring 24e encloses the inner end portions 34e of the airfoils 24e and the main body 120e of the ceramic core material. The molten metal of the shroud ring 26e extends across the ends of the airfoils 24e in the space between the bodies 120e of core material 118e at a circular inner mold surface to form an imperforate end wall section 114e of the inner shroud ring 26e.

After the molten metal in the outer shroud ring mold cavity 96e has solidified, the molten metal in the inner shroud ring mold cavity 94e solidifies. After the molten metal in the inner shroud ring mold cavity 94e has almost solidified, the molten metal in the gating system solidifies. As the molten metal in the gating system solidifies, it contracts.

When the metal in the gating system contracts and pulls the inner shroud ring 26e radially inwardly, the core material 118e moves with the metal of the inner shroud ring and separates from the end surface 110e of the airfoil 24e, in the manner shown in FIG. 17. The contraction of the metal in the gating system applies radially inwardly directed forces, indicated by the arrow 84e in FIG. 17. These forces move the metal of the inner shroud ring to initially form the cavity or space 52e between the inner end surface 110e of the airfoil 24e and the core material 118e in the manner previously explained in conjunction with the embodiment of the invention illustrated in FIGS. 1–9.

Once the metal in the mold 60e has solidified, the mold material 92e is removed and the core material is removed from the cavity 52e. The core material is removed from the cavity 52e through openings fromed in the shroud ring by the support sections 122e of the mold material. It should be noted that the support section 122e extends radially outwardly through a radially outer side surface of the inner shroud ring 26e. This results in the radially inner side surface and rail 132 of the shroud ring 26e being imperforate or free of openings.

Once the metal in the mold 60e has solidified, the mold material 118e is removed through an opening formed in the radially outer side surface of the inner shroud ring 26e by the support section 122e of core material. This opening is disposed along the radially extending side surface 46e of the airfoil 24e.

After the core material 118e has been completely removed from the cavity 52e, the cavity or space will have a radial extent equal to the sum of the distance which the shroud ring 26e moved inwardly by contraction of the metal in the gating system and the radial extent of the body 120e of core material. Of course, the radial extent of the body 120e of core material can be selected to provide the cavity 52e with any desired radial dimension and/or configuration. Once the core material has been removed from the cavity 52e, the opening in the radially outer side surface of the shroud ring 26e through which the core material was removed can be blocked if desired. It should be understood that the radially inner ends of the as cast cavities 52e are completely blocked by cast, imperforate end wall sections 114e which extend across the ends of the airfoils 24e. Thus, generally cylindrical inner side surface of the inner shroud ring 24e and the rail 132e are free of openings to the as cast cavities or spaces 52e. The airfoils 24e extend through the only openings to the cavities 52e. Therefore, it is impossible, under any engine operating conditions, to have a flow of gas in a radial direction through the inner shroud ring 26e.

During operation of an engine, the airfoils 24e are exposed to gas which comes directly from the combustion chamber of the engine. The airfoils 24e become hotter than the inner and outer shroud rings. Therefore, the airfoils 24e tend to expand along their longitudinal axes, that is in the radial direction relative to the inner shroud ring 26e. In the absence of slip joints between the inner end portions 34e of the airfoils 24e and the inner shroud ring 26e, substantial thermal stresses would be set up in the airfoils and in the inner and outer shroud rings.

As the airfoils 24e are heated to a temperature which is above the temperature of the inner and outer shroud rings 26e and 28e, the inner ends of the airfoils 24e move radially inwardly relative to the inner shroud ring 26e. As this occurs, the inner ends 34e of the airfoils move into the closed-ended cavities 54e. Since the closed-ended cavities 54e have a relatively large radial extent due to the combined effects of moving the inner shroud ring 26e radially inwardly relative to the airfoils 24e and removing the core material 118e, the airfoils 24e can expand through a relatively large distance relative to the shroud rings. By properly sizing the core material 118e, the closed-ended cavities 52e can be sized to accommodate any desired radial expansion of the airfoils 24e. In fact, the closed-ended cavities could be entirely formed by removing the core material 118e.

It should be understood that although the method of forming the mold has been most fully described in conjunction with the embodiment of the invention illustrated in FIGS. 1–9, the molds for the embodiments of the invention illustrated in FIGS. 10–17 are formed in the same way as the mold for the embodiment of the invention illustrated in FIGS. 1–9. It should also be understood that although rails have been illustrated in conjunction with only the embodiments of the invention illustrated in FIGS. 15–17, similar rails could be provided with the other embodiments of the invention if desired. It should also be understood that although it is preferred to form the cavities in the inner shroud ring by pulling the inner shroud ring inwardly as the molten metal in the gating system contracts, cavities could be formed in the outer shroud ring if desired. While it is believed that it may be preferred to provide the cavities in the inner shroud ring with an imperforate end wall to prevent flow of gas through the cavities under any engine operating conditions, it is believed that some turbine engine components may be constructed with open-ended cavities rather than closed-ended cavities.

Conclusion

The present invention provides a new and improved method of making an improved turbine engine component having a plurality of airfoils 24 disposed in an annular array 22 between shroud rings 26 and 28. Cavities 52 are provided in at least one of the shroud rings adjacent to end portions of the airfoils 24 to accommodate thermal expansion of the airfoils. The cavities may be open-ended (FIGS. 2 and 3), completely closed-ended (FIGS. 11, 12, 15, 16 and 17), or partially closed-ended (FIG. 13).

Figure 7:
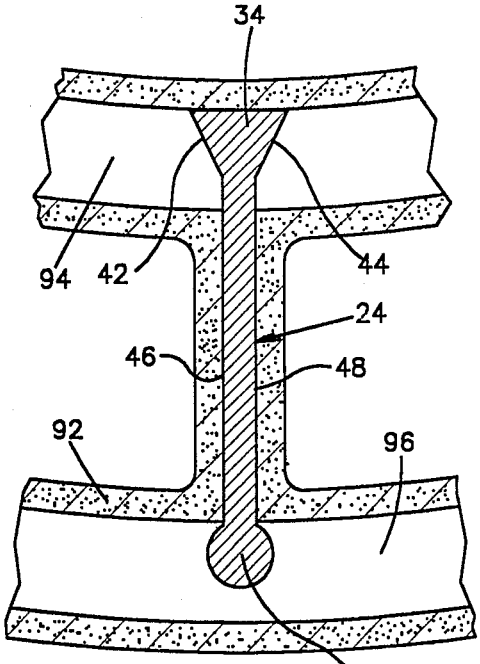
FIG. 7 is a fragmentary sectional view illustrating the relationship between the airfoil and annular shroud ring mold cavities formed by removing the shroud ring patterns of FIG. 6.

When the illustrated embodiments of the improved turbine engine component are to be made, a plurality of airfoils 24 are positioned in an annular array with end portions 34 of the airfoils at least partially enclosed by a shroud ring pattern 88 (FIG. 6). The shroud ring pattern 88 is covered with mold material 92. The shroud ring pattern material 88 is then removed to leave a shroud ring mold cavity 94 (FIG. 7). Molten metal is poured into the shroud ring mold cavity 94 and solidified. Cavities 52 (FIG. 9) are formed in the shroud ring 26 at locations adjacent to end portions 34 of the airfoils 24 by causing relative movement to occur between the airfoils and the shroud ring.

The relative movement between the airfoils 24 and the shroud ring 26 may be induced by thermal contraction of metal in a gating system 68 through which molten metal was supplied to the shroud ring mold cavity 94. Thus, as the metal in the gating system 68 solidifies and contracts, the shroud ring 26 is pulled away from the ends 34 of the airfoils 24 by the metal in the gating system to form cavities or spaces 52 in the shroud ring. If desired, the cavities 52 in the shroud ring 26 could be formed by moving the airfoils 24 rather than the metal of the shroud ring.

In other specific embodiments of the invention, core material 118 (FIGS. 14 and 17) is used in the formation of the cavities 52c. The core material 118 is located at the ends 34c of airfoils 24c which are enclosed by a shroud ring pattern. The shroud ring pattern and the core material 118 are covered with ceramic mold material 92c. The shroud ring pattern material is removed and molten metal is poured into the resultant mold cavity 94c. After the molten metal has solidified to form a shroud ring 26c, the core material is removed from the shroud ring.

The cavities or spaces 52 which are formed in a shroud ring may have closed ends (FIGS. 11, 12, 15, 16 and 17) to prevent even a very small flow of gas in a radial direction along the airfoils 24a through the shroud ring 26a. If desired, the cavities could be formed with a partially open ends (FIG. 13). End wall sections 114b of the partially open-ended cavities 52b form bridge or connector sections which extend across ends 34b of the airfoils 24b to transmit forces and prevent deformation of the shroud ring 26b. Of course, completely open-ended cavities 52 could be provided in the shroud ring.

Having described specific preferred embodiments of the invention, the following is claimed:

1. A method of making a turbine engine component having a plurality of airfoils disposed in an annular array between inner and outer shroud rings, said method comprising the steps of positioning a plurality of airfoils in an annular array with outer end portions of the airfoils at least partially embedded in an outer shroud ring pattern and with inner end portions of the airfoils at least partially embedded in an inner shroud ring pattern, covering the shroud ring patterns with mold material to form a mold, removing the shroud ring pattern material from the mold to leave inner and outer shroud ring mold cavities having configurations corresponding to the configurations of the shroud ring patterns, the inner and outer end portions of the airfoils being at least partially disposed in the shroud ring mold cavities, filling the inner and outer shroud ring mold cavities with molten metal, said step of filling the inner and outer shroud ring mold cavities with molten metal including at least partially enclosing the inner and outer end portions of the airfoils with molten metal, solidifying the molten metal in the inner and outer shroud ring mold cavities to form the inner and outer shroud rings, and forming cavities in at least one of the shroud rings at locations adjacent to end portions of the airfoils by moving the airfoils and the one shroud ring relative to each other.

2. A method as set forth in claim 1 wherein said step of filling the inner and outer shroud ring mold cavities with molten metal includes conducting molten metal through a gating system to the mold cavities, said method further including solidifying molten metal in the gating system, said step of solidifying the molten metal in the inner and outer shroud ring mold cavities including completing the solidification of the molten metal in the outer shroud ring mold cavity before completing the solidification of the molten metal in the inner shroud ring mold cavity and completing solidification of the molten metal in the inner shroud ring mold cavity before completing the solidification of the molten metal in the gating system.

3. A method as set forth in claim 2 wherein said step of moving the airfoils and the one shroud ring relative to each other includes moving the inner shroud ring relative to the airfoils under the influence of force transmitted from the metal in the gating system to the inner shroud ring.

4. A method as set forth in claim 1 wherein said step of moving the airfoils and the one shroud ring relative to each other includes moving the one shroud ring relative to the airfoils and the other shroud ring.

5. A method as set forth in claim 1 wherein said step of moving the airfoils and the one shroud ring relative to each other includes moving the one shroud ring relative to the other shroud ring.

6. A method as set forth in claim 1 wherein said step of forming cavities in at least one of the shroud rings includes forming cavities which are completely closed at ends of the cavities opposite from openings through which the airfoils extend into the cavities.

7. A method as set forth in claim 1 wherein said step of solidifying the molten metal in the inner and outer shroud ring mold cavities includes solidifying the molten metal in the outer shroud ring mold cavity to grip the outer end portions of the airfoils, said step of forming cavities in at least one of the shroud rings includes moving the inner shroud ring relative to the airfoils while gripping the outer end portions of the airfoils with the outer shroud ring.

8. A method as set forth in claim 1 wherein said step of positioning a plurality of airfoils in an annular array with outer end portions of the airfoils at least partially embedded in an outer shroud ring pattern and inner end portions of the airfoils at least partially embedded in an inner shroud ring pattern includes providing core material at end portions of the airfoils, said step of filling the inner and outer shroud ring mold cavities with molten metal includes engaging the core material with the molten metal, said step of forming cavities in at least one of the shroud rings includes removing core material from the one shroud ring.

9. A method as set forth in claim 8 wherein said step of removing core material from the one shroud ring includes removing the core material from the one shroud ring through openings formed in the one shroud ring.

10. A method as set forth in claim 1 wherein said step of solidifying the molten metal in the inner and outer shroud ring mold cavities includes solidifying the molten metal in the shroud ring mold cavity in which the one shroud ring is located without forming significant bonds between the end portions of the airfoils and the metal of the one shroud ring.

11. A method as set forth in claim 1 wherein said step of forming cavities in at least one of the shroud rings is performed prior to completion of solidification of the molten metal in the one shroud ring mold cavity and after completion of solidification of the molten metal in the other shroud ring mold cavity.

12. A method as set forth in claim 1 wherein said step of forming cavities in at least one of the shroud rings is performed with the inner and outer shroud rings in the inner and outer shroud ring mold cavities.

13. A method as set forth in claim 1 wherein said step of forming cavities in at least one of the shroud rings is started when the one shroud ring is in a shroud ring mold cavity and is completed after the one shroud ring has been removed from a shroud ring mold cavity.

14. A method as set forth in claim 13 wherein said step of forming cavities in at least one of the shroud rings includes removing core material from within the one shroud ring after the one shroud ring has been removed from a shroud ring mold cavity.

15. A method of casting a turbine engine component having a plurality of airfoils extending between annular inner and annular outer shroud rings, said method comprising the steps of forming a mold with a plurality of airfoils extending between annular inner and annular outer shroud ring forming portions of the mold, solidifying molten metal in the annular inner shroud ring forming portion of the mold around inner end portions of the airfoils to form an inner shroud ring, solidifying molten metal in the annular outer shroud ring forming portion of the mold around outer end portions of the airfoils to form an outer shroud ring, and forming space in the inner shroud ring adjacent to end portions of the airfoils by pulling metal in the inner shroud ring forming portion of the mold inwardly under the influence of force transmitted from metal in a portion of the mold disposed radially inwardly of the inner end portions of the airfoils.

16. A method as set forth in claim 15 wherein said step of solidifying molten metal in the outer shroud ring forming portion of the mold includes gripping the outer end portions of the airfoils with the metal in the outer shroud ring forming portion of the mold, said step of forming space adjacent to end portions of the airfoils includes holding the airfoils against movement during pulling of metal in the inner shroud ring forming portion of the mold by gripping the airfoils with the metal in the outer shroud ring forming portion of the mold.

17. A method as set forth in claim 15 wherein the step of pulling metal in the inner shroud ring forming portion of the mold inwardly includes transmitting force from metal disposed in a gating portion of the mold to metal disposed in the inner shroud ring forming portion of the mold.

18. A method as set forth in claim 15 wherein said step of pulling metal in the inner shroud ring forming portion of the mold inwardly is performed after completing said step of solidifying molten metal in the outer shroud ring forming portion and prior to completion of said step of solidifying molten metal in the inner shroud ring forming portion of the mold.

19. A method of casting a turbine engine component having a plurality of airfoils extending between inner and outer shroud rings, said method comprising the steps of forming a mold with a plurality of airfoils extending between inner and outer shroud ring forming portions of the mold, conducting molten metal into the inner and outer shroud ring forming portions of the mold, and moving the metal in one of the shroud ring forming portions relative to the airfoils and the metal in the other shroud ring forming portion to form a plurality of cavities in the metal in the one shroud ring forming portion at locations adjacent to end portions of the airfoils.

20. A method as set forth in claim 19 wherein said step of conducting molten metal into the inner and outer shroud ring forming portions includes conducting molten metal through a gating system, said step of moving the metal in one of the shroud ring forming portions including transmitting force from the gating system to the one shroud ring forming portion.

21. A method as set forth in claim 19 further including the steps of positioning core material at end portions of the airfoils, said step of conducting molten metal into the inner and outer shroud ring forming portions includes engaging the core material with the molten metal, said step of moving the metal in one of the shroud ring forming portions to form a plurality of cavities including forming cavities adjacent to airfoil end portions at which the core material was positioned during performance of said step of positioning core material, said method further including removing core material from the cavities.

22. A method as set forth in claim 21 wherein said step of moving the metal in one of the shroud ring forming portions to form a plurality of cavities is performed prior to performance of said step of removing core material from the cavities, said step of removing the core material from the cavities includes removing the core material through openings which are at least partially defined by one of the shroud rings.

23. A method as set forth in claim 22 further including the step of blocking the openings through which the core material is removed.

24. A method as set forth in claim 19 further including the step of solidifying molten metal in said other shroud ring forming portion to grip end portions of the airfoils prior to performing said step of moving the metal in said one shroud ring forming portion.

25. A method of making a turbine engine component having a plurality of airfoils disposed in an annular array between inner and outer shroud rings, said method comprising the steps of positioning a plurality of airfoils in an annular array with outer end portions of the airfoils at least partially embedded in an outer shroud ring pattern and with inner end portions of the airfoils at least partially embedded in an inner shroud ring pattern, at least partially covering each of the airfoils with a thin layer of pattern material, thereafter, covering the shroud ring patterns and at least a portion of each of the airfoils with mold material to form a mold, removing the shroud ring pattern material from the mold to leave inner and outer shroud ring mold cavities having configurations corresponding to the configurations of the shroud ring patterns, the inner and outer end portions of the airfoils being at least partially disposed in the shroud ring mold cavities, removing the thin layers of pattern material covering each of the airfoils to leave spaces between the airfoils and the mold material, heating the mold, thermally expanding the airfoils during said step of heating the mold, moving surfaces on the airfoils into engagement with the mold material during performance of said step of thermally expanding the airfoils, filling the inner and outer shroud ring mold cavities with molten metal, said step of filling the inner and outer shroud ring mold cavities with molten metal including at least partially enclosing the inner and outer end portions of the airfoils with molten metal, and solidifying the molten metal in the inner and outer shroud ring mold cavities to form the inner and outer shroud rings.

26. A method as set forth in claim 25 wherein said step of filling the inner and outer shroud ring mold cavities with molten metal includes conducting molten metal through a gating system to the mold cavities, said method further including solidifying molten metal in the gating system, said step of solidifying the molten metal in the inner and outer shroud ring mold cavities including completing the solidification of the molten metal in the outer shroud ring mold cavity before completing the solidification of the molten metal in the inner shroud ring mold cavity and completing solidification of the molten metal in the inner shroud ring mold cavity before completing the solidification of the molten metal in the gating system.

27. A method as set forth in claim 26 further including the steps of moving the airfoils and the one shroud ring relative to each other under the influence of force transmitted from the metal in the gating system to the inner shroud ring.

28. A method as set forth in claim 25 further including the step of moving the airfoils and one of the shroud rings relative to each other to form cavities in the one shroud ring adjacent to end portions of the airfoils.

29. A method as set forth in claim 25 further including the step of forming cavities which are disposed in one of the shroud rings adjacent to end portions of the airfoils and are completely closed at ends of the cavities opposite from openings through which the airfoils extend into the cavities.

30. A method as set forth in claim 29 wherein said step of forming cavities includes moving the airfoils and one shroud ring relative to each other.

31. A method as set forth in claim 30 wherein said step of positioning a plurality of airfoils in an annular array with outer end portions of the airfoils at least partially embedded in an outer shroud ring pattern and inner end portions of the airfoils at least partially embedded in an inner shroud ring pattern includes providing core material at end portions of the airfoils, said step of filling the inner and outer shroud ring mold cavities with molten metal includes engaging the core material with the molten metal, said step of forming cavities disposed in one of the shroud rings includes removing core material from the one shroud ring.

32. A method as set forth in claim 31 wherein said step of removing core material from the one shroud ring includes removing the core material from the one shroud ring through openings formed in the one shroud ring, said method further including the step of blocking the openings in the one shroud ring after removing the core material.

33. A method as set forth in claim 25 wherein said step of solidifying the molten metal in the inner and outer shroud ring mold cavities includes solidifying the molten metal in the shroud ring mold cavities without forming significant metallurgical bonds between the end portions of the airfoils and the metal of the shroud rings.

34. A method as set forth in claim 25 further including the steps of forming cavities in at least one of the shroud rings prior to completion of solidification of the molten metal in the one shroud ring mold cavity and after completion of solidification of the molten metal in the other shroud ring mold cavity.

35. A method of casting a turbine engine component having a plurality of airfoils extending between inner and outer shroud rings, said method comprising the steps of forming a mold with a plurality of airfoils extending between inner and outer shroud ring forming portions of the mold, conducting molten metal into the inner and outer shroud ring forming portions of the mold, and solidifying the molten metal in the inner and outer shroud ring forming portions of the mold to form inner and outer shroud rings, said step of solidifying the molten metal in the inner and outer shroud ring forming portions of the mold including forming a plurality of closed-ended cavities in one of the shroud rings as the molten metal in one of the shroud ring forming portions of the mold solidifies.

36. A method as set forth in claim 35 wherein said step of forming a plurality of closed-ended cavities in one of the shroud ring forming portions of the mold as the molten metal in the one shroud ring forming portion solidifies includes forming each of the cavities with an opening through which one end portion of an airfoil extends into the cavity and an imperforate end wall at an end of the cavity opposite from the opening and spaced from the one end portion of the airfoil.

37. A method as set forth in claim 36 wherein said step of forming a plurality of closed-ended cavities in one of the shroud rings as the molten metal in the one shroud ring forming portion solidifies further includes moving the metal in the one shroud ring forming portion relative to the airfoils and the metal in the other shroud ring forming portion.

38. A method as set forth in claim 37 wherein said step of conducting molten metal into the inner and outer shroud ring forming portions of the mold includes conducting molten metal through a gating system, said step of moving the metal in the one shroud ring forming portion including transmitting force from the gating system to the one shroud ring forming portion.

39. A method as set forth in claim 37 further including the steps of positioning core material in engagement with the one end portion of each of the airfoils, said step of conducting molten metal into the inner and outer shroud ring forming portions includes engaging the core material with the molten metal, said step of moving the metal in the one shroud ring forming portion includes forming cavities adjacent to airfoil end surfaces which were engaged by the core material during performance of said step of positioning core material, said method further including removing core material from the cavities.

40. A method as set forth in claim 39 wherein said step of removing the core material from the cavities includes removing the core material through openings which are spaced from the imperforate end walls.

41. A method as set forth in claim 37 further including the step of solidifying molten metal in the other shroud ring forming portion to grip end portions of the airfoils prior to performing said step of moving the metal in said one shroud ring forming portion.

42. A method as set forth in claim 35 wherein said step of conducting molten metal into the inner and outer shroud ring forming portions of the mold includes conducting molten metal through a gating system to the shroud ring forming portions, said method further including solidifying molten metal in the gating system, said step of solidifying the molten metal in the inner and outer shroud ring forming portions including completing the solidification of the molten metal in the outer shroud ring forming portion before completing the solidification of the molten metal in the inner shroud ring forming portion and completing solidification of the molten metal in the inner shroud ring forming portion before completing the solidification of the molten metal in the gating system, said step of forming a plurality of closed-ended cavities in one of the shroud ring forming portions including forming closed-ended cavities in the inner shroud ring forming portion.

43. A method as set forth in claim 42 further including the steps of moving the airfoils and the metal in the inner shroud ring forming portion relative to each other under the influence of force transmitted from the metal in the gating system to the metal in the inner shroud ring forming portion.

44. A method as set forth in claim 35 wherein said step of forming a mold with a plurality of airfoils extending between inner and outer shroud ring forming portions of the mold includes positioning a plurality of airfoils in an annular array with outer end portions of the airfoils at least partially embedded in an outer shroud ring pattern and with inner end portions of the airfoils at least partially embedded in an inner shroud ring pattern, at least partially covering each of the airfoils with a thin layer of pattern material, thereafter, covering the shroud ring patterns and at least a portion of each of the airfoils with mold material to form the mold, removing shroud ring pattern material from the mold to leave inner and outer shroud ring forming portions having configurations corresponding to the configurations of the shroud ring patterns, the inner and outer end portions of the airfoils being at least partially disposed in the inner and outer shroud ring forming portions of the mold, removing the thin layers of pattern material covering each of the airfoils to leave space between the airfoils and the mold material, said method further including heating the mold, thermally expanding the airfoils during said step of heating the mold, moving surfaces of the airfoils into engagement with the mold material during performance of said step of thermally expanding the airfoils.

* * * * *